US006763902B2

(12) United States Patent
Larsen et al.

(10) Patent No.: US 6,763,902 B2
(45) Date of Patent: Jul. 20, 2004

(54) ROCKBIT WITH ATTACHABLE DEVICE FOR IMPROVED CONE CLEANING

(75) Inventors: James L. Larsen, Spring, TX (US); Dwayne P. Terracina, Spring, TX (US)

(73) Assignee: Smith International, Inc., Houston, TX (US)

( * ) Notice: Subject to any disclaimer, the term of this patent is extended or adjusted under 35 U.S.C. 154(b) by 55 days.

(21) Appl. No.: 09/814,916

(22) Filed: Mar. 22, 2001

(65) Prior Publication Data

US 2003/0196836 A1 Oct. 23, 2003

Related U.S. Application Data

(63) Continuation-in-part of application No. 09/547,691, filed on Apr. 12, 2000, now Pat. No. 6,571,887.

(51) Int. Cl.[7] ..... E21B 10/18
(52) U.S. Cl. ..... 175/340; 175/424
(58) Field of Search ..... 175/340, 339, 175/424

(56) References Cited

U.S. PATENT DOCUMENTS

| | | | | | |
|---|---|---|---|---|---|
| 1,999,131 | A | * | 4/1935 | Reed | 175/339 |
| 4,082,015 | A | | 4/1978 | Craig | 76/108 |
| 4,285,409 | A | | 8/1981 | Allen | 175/336 |
| 4,369,849 | A | * | 1/1983 | Parrish | 175/340 |
| 4,516,642 | A | | 5/1985 | Childers et al. | 175/340 |
| 4,546,837 | A | | 10/1985 | Childers et al. | 175/340 |
| 4,558,754 | A | | 12/1985 | Childers et al. | 175/340 |
| 4,582,149 | A | * | 4/1986 | Slaughter, Jr. | 175/340 |
| 4,741,406 | A | | 5/1988 | Deane et al. | 175/340 |
| 4,776,412 | A | | 10/1988 | Thompson | 175/393 |
| 4,794,995 | A | | 1/1989 | Matson et al. | 175/393 |
| 4,848,476 | A | | 7/1989 | Deane et al. | 175/340 |
| 4,989,680 | A | | 2/1991 | Deane et al. | 175/340 |
| 5,029,656 | A | | 7/1991 | Ivie et al. | 175/340 |
| 5,096,005 | A | | 3/1992 | Ivie et al. | 175/340 |
| 5,335,738 | A | * | 8/1994 | Waldenstrom et al. | 175/420.2 |
| 5,669,459 | A | | 9/1997 | Larsen et al. | 175/340 |
| 5,676,214 | A | * | 10/1997 | Pearce et al. | 175/340 |
| 6,098,728 | A | * | 8/2000 | Wells et al. | 175/340 |
| 6,098,730 | A | * | 8/2000 | Scott et al. | 175/432 |
| 6,571,887 | B1 | * | 6/2003 | Nguyen et al. | 175/57 |

FOREIGN PATENT DOCUMENTS

| | | |
|---|---|---|
| GB | 2328234 | 2/1999 |
| GB | 2348449 A | 10/2000 |
| GB | 2348912 A | 10/2000 |
| SU | 1613563 A | 12/1990 |

OTHER PUBLICATIONS

UK Search Report for British Application No. GB 0109304.6 dated Aug. 23, 2001 (2 p.).
Magnum Rock Bits; Smith Tool, a Business Unit of Smith International, Inc.; 1998; (16 p.).
United Kingdom Patent Search for Application No. GB0206832.8 dated Jul. 1, 2002, 3 pages.

* cited by examiner

*Primary Examiner*—Hoang Dang
(74) *Attorney, Agent, or Firm*—Conley Rose, P.C.

(57) ABSTRACT

A rolling cone rock bit having one or more nozzle retention bodies attached by a single orientation mounting is disclosed, as is the associated method for its manufacture. The upper end of the nozzle retention body has a fluid inlet in communication with the internal fluid plenum of the drill bit, and the lower end of the nozzle retention body includes a fluid outlet that defines an exit flow angle. The fluid outlet is located between two rolling cones, but is positioned closer to one of the cones than the other. Further, the exit flow angle is preferably within 3 degrees of parallel to the drill bit longitudinal axis and, even more preferably, is parallel with the drill bit longitudinal axis.

59 Claims, 20 Drawing Sheets

ROCKBIT WITH ATTACHABLE DEVICE FOR IMPROVED CONE CLEANING

CROSS-REFERENCE TO RELATED APPLICATION

This is a continuation-in-part application of U.S. patent application Ser. No. 09/547,691 filed Apr. 12, 2000, now U.S. Pat. No. 6,571,887 issued on Jun. 3, 2003 and entitled Directional Flow Nozzle Retention Body, which is incorporated herein by reference in its entirety.

BACKGROUND OF THE INVENTION

Roller cone bits, variously referred to as rock bits or drill bits, are used in earth drilling applications. Typically, these are used in petroleum or mining operations where the cost of drilling is significantly affected by the rate that the drill bits penetrate the various types of subterranean formations. There is a continual effort to optimize the design of drill bits to more rapidly drill specific formations so as to reduce these drilling costs.

One design element that significantly affects the drilling rate of the rock bit is the hydraulics. As they drill, the rock bits generate rock fragments known as drill cuttings. These rock fragments are carried uphole to the surface by a moving column of drilling fluid that travels to the interior of the drill bit through the center of an attached drill string, is ejected from the face of the drill bit through a series of jet nozzles, and is carried uphole through an annulus formed by the outside of the drill string and the borehole wall.

Bit hydraulics can be used to accomplish many different purposes on the hole bottom. Generally, a drill bit is configured with three cones at its bottom that are equidistantly spaced around the circumference of the bit. These cones are imbedded with inserts (otherwise known as teeth) that penetrate the formation as the drill bit rotates in the hole. Generally, between each pair of cones is a jet bore with an installed erosion resistant nozzle that directs the fluid from the face of the bit to the hole bottom to move the cuttings from the proximity of the bit and up the annulus to the surface. The placement and directionality of the nozzles as well as the nozzle sizing and nozzle extension significantly affect the ability of the fluid to remove cuttings from the bore hole.

The optimal placement, directionality and sizing of the nozzle can change depending on the bit size and formation type that is being drilled. For instance, in soft, sticky formations, drilling rates can be reduced as the formation begins to stick to the cones of the bit. As the inserts attempt to penetrate the formation, they are restrained by the formation stuck to the cones, reducing the amount of material removed by the insert and slowing the rate of penetration (ROP). In this instance, fluid directed toward the cones can help to clean the inserts and cones allowing them to penetrate to their maximum depth, maintaining the rate of penetration for the bit. Furthermore, as the inserts begin to wear down, the bit can drill longer since the cleaned inserts will continue to penetrate the formation even in their reduced state. Alternatively, in a harder, less sticky type of formation, cone cleaning is not a significant deterrent to the penetration rate. In fact, directing fluid toward the cone can reduce the bit life since the harder particles can erode the cone shell causing the loss of inserts. In this type of formation, removal of the cuttings from the proximity of the bit can be a more effective use of the hydraulic energy. This can be accomplished by directing two nozzles with small inclinations toward the center of the bit and blanking the third nozzle such that the fluid impinges on the hole bottom, sweeps across to the blanked side and moves up the hole wall away from the proximity of the bit. This technique is commonly referred to as a cross flow configuration and has shown significant penetration rate increases in the appropriate applications. In other applications, moving the nozzle exit point closer to the hole bottom can significantly affect drilling rates by increasing the impact pressures on the formation. The increased pressure at the impingement point of the jet stream and the hole bottom as well as the increased turbulent energy on the hole bottom can more effectively lift the cuttings so they can be removed from the proximity of the bit.

Unfortunately, modifications to bit hydraulics have generally been difficult to accomplish. Usually, bits are constructed using one to three legs that are machined from a forged component. This forged component, called a leg forging, has a predetermined internal fluid cavity (or internal plenum) that directs the drilling fluid from the center of the bit to the peripheral jet bores. A receptacle for an erosion resistant nozzle is machined into the leg forging, as well as a passageway that is in communication with the internal plenum of the bit. Typically, there is very little flexibility to move the nozzle receptacle location or to change the center line direction of the nozzle receptacle because of the geometrical constraints for the leg forging design. To change the hydraulics of the bit, it would be possible to modify the leg forging design to allow the nozzle receptacle to be machined in different locations depending on the desired flow pattern. However, due to the cost of making new forging dies and the expense of inventorying multiple forgings for a single size bit, it would not be cost effective to frequently change the forging to meet the changing needs of the hydraulic designer. In order to increase the ability of optimizing the hydraulics to specific applications, a more cost effective and positionally/vectorally flexible design methodology is needed to allow specific rock bit sizes and types to be optimize for local area applications.

Previous methods to improve borehole hydraulics include some means to move the nozzle exit closer to the hole bottom to increase the bottom hole energy. U.S. Pat. No. 3,363,706 teaches the use of an extended tube that extends between the cones and moves the nozzle exit point within 1"–2" from the hole bottom. The extended nozzle tube is made of steel and welded to the bit and contains a receptacle for the installation of erosion resistant nozzles.

Another configuration following the same approach uses mini-extended nozzles. Mini-extended nozzles are made from erosion resistant materials such as tungsten carbide and are longer in length than the standard nozzle and thus protrude beyond the nozzle receptacle. While the mini-extended nozzles do not move the nozzle exit as close to the hole bottom as the extended nozzle tube, the additional 1.3"–2.5" of extension significantly increases the bottom hole impact pressures. For instance, a standard nozzle and a mini-extended nozzle were tested in a chamber to measure the impact pressures for a given flow rate while installed in a 7⅞" bit. Using 3 11/32" nozzles, the standard nozzle impingement pressure was measured at 175 PSI. The mini-extended nozzle with 1.5" additional extension to the hole bottom, had an impingement pressure of 360 PSI. Drilling tests in a down hole simulator have shown increases of up to 30% in drilling rates when using mini-extended nozzles in the place of standard nozzles.

The prior art also has several other examples of attachable bodies used to improve the bit hydraulics. U.S. Pat. Nos. 4,516,642; 4,546,837; 5,029,656; and 5,096,005 all teach the use of directed nozzles that incline the jets towards the cones to focus the energy on the inserts for the purpose of ensuring they are clean and will penetrate into the formation. Bits of this type have been shown to have an advantage in sticky formations and in applications where the energy expended across the bit is very low. The drawback of this type of configuration is that the impact pressures on the hole bottom are significantly reduced since the fluid strikes the formation at an inclined angle and because the distance the fluid must travel before it hits the hole bottom is increased. For example, FIG. 11 is a graph showing a modeled set of relationships between impact pressure and flow rate for various configurations. In particular, in order of increasing slope, FIG. 11 shows calculated impact pressure/flow rate relationships for 1) an angled fluid discharge column; 2) a vertical fluid discharge column with no cross flow; 3) a vertical discharge column with cross flow; and 4) a vertical fluid discharge column with extended nozzles and cross flow. As can be seen, mini-extended nozzles, cross flow, and a vertical fluid discharge each affect impact pressure on the borehole bottom. Drill bits built to direct drilling fluid at an angle toward the cutting teeth or inserts also can suffer from greater than desirable cone shell erosion that can cause lost inserts, especially when the formation is abrasive. In certain applications, this form of hydraulics could also cause increased seal failures since high-velocity drilling fluid passes by the cone/leg interface and can push particles into the seal area.

U.S. Pat. No. 5,669,459 (hereby incorporated by reference for all purposes) teaches the use of several different types of machined slots in the leg forging and a weldably attached body that mates to the machined slots and that directs the fluid from the interior plenum to the outside of the bit. One slot design allows the attachable body to be pivoted in one direction to radially adjust the exit vector of the nozzle. A second slot design uses a ball and socket type design that would allow the tube to be vectored both radially and laterally. However, in both of these designs it is difficult to align the vector angle, and both designs require costly fixtures to ensure the correct angle for the attached body. Furthermore, this type of slot is difficult and costly to machine. Moreover, the internal entrance to the weldable body is necessarily smaller than the machined opening of the slot to account for the variations in the nozzle body angles. This difference between the entrance to the attached tube and the machined slot opening creates a fluidic discontinuity in the path of the fluid from the center of the bit through the slot opening and into the tube. This discontinuity can cause turbulent recirculation zones that can erode through the side wall of the bit causing premature bit failure. Such bit failures are unacceptable in drilling applications due to the high costs of drill bits and lost drilling time. A third slot design teaches a slot with only one orientation where the opening in the forging is closely matched to the entrance to the attachable body. This matched interface significantly reduces fluidic erosion increasing the reliability of the system. However, the slot does not include the ability to change the vector of the fluid system. This particular system directs the fluid parallel to the bit center line toward the hole bottom.

Each of the above mentioned configurations can improve drilling rates if they are used in the appropriate application. However, it would be desirable to be able to provide significant cone cleaning while still being able to maintain high impact pressures on the bottom hole. It would also be desirable to be able to easily change the hydraulic configuration depending on the drilling application. Consequently, it would be desirable to have a drill bit design that overcomes these and other problems.

BRIEF SUMMARY OF THE INVENTION

An embodiment of the invention is a drill bit defining a longitudinal axis and an internal fluid plenum for allowing fluid to pass through, and having a first cone and a second cone, a nozzle retention body having an upper end and a lower end, the upper end including a fluid inlet that is in fluid communication with the internal fluid plenum and the lower end defining a fluid exit flow angle. The fluid outlet is closer to the first cone than the second cone.

Preferably, the embodiment also includes an exit flow angle of less than about 3 degrees. Even more preferably, the embodiment includes an exit flow angle of that is parallel to the longitudinal axis of the drill bit body. Another preference is the distance between the projected centroid of the fluid outlet, which follows along an axis created by the exit flow angle, and the closest point attained by the tip of the inserts on the closest adjacent cone. Preferably, this distance is less than 3% of the bit diameter, and even more preferably, it is less than 2% of the drill bit diameter.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENTS

Figure 1:
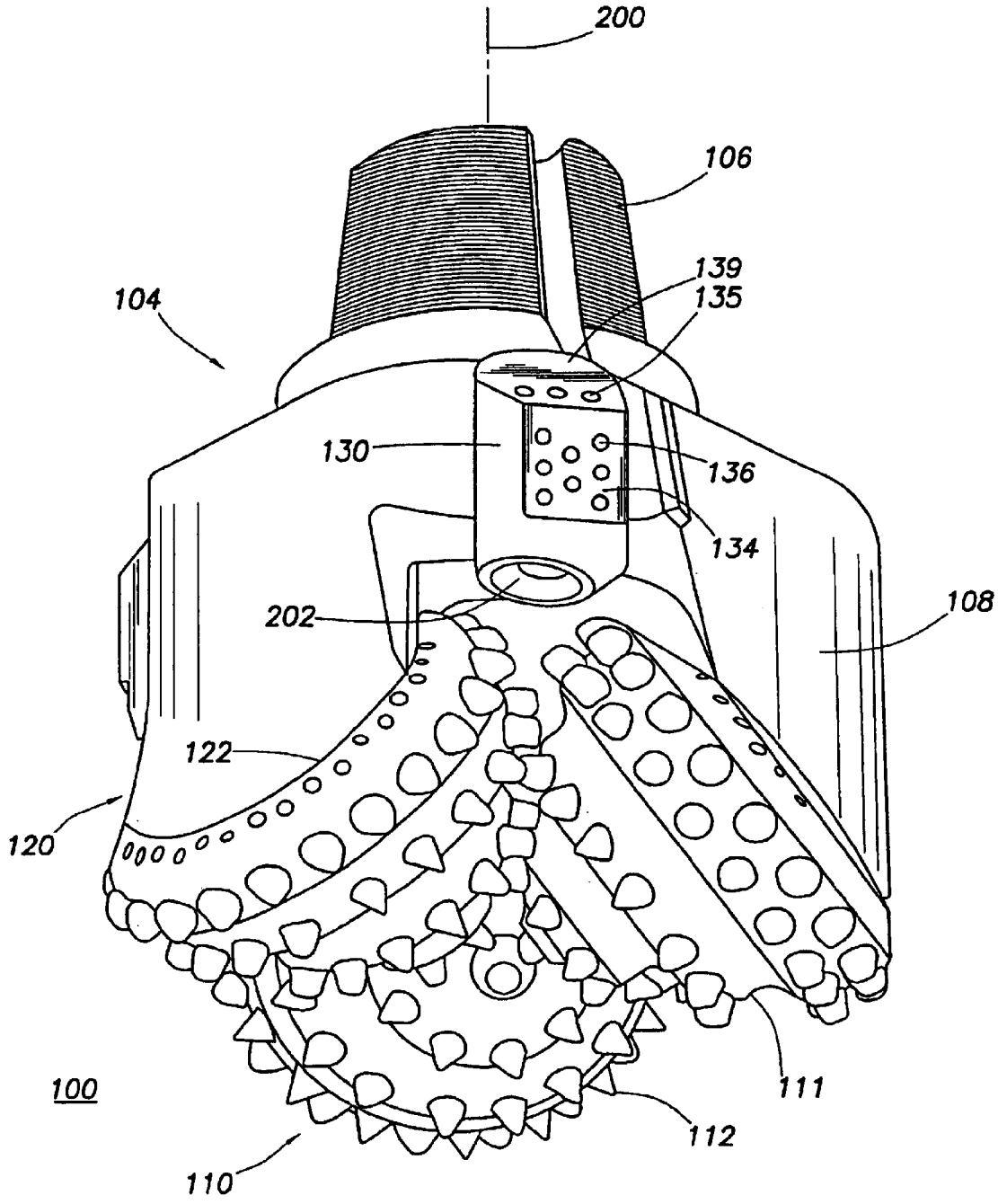
FIG. 1 is a perspective view of a rock bit with an angled nozzle retention body.

Referring to FIG. 1, a roller-cone bit in accordance with a preferred embodiment of the invention is shown. Roller cone bit 100 includes a body 102 and an upper end 104 that includes a threaded pin connection 106 for attachment of a drill string used to raise, lower, and rotate bit 100 during drilling. Drill bit body 102 forms an interior fluid chamber or plenum 13 (as shown in FIG. 2B) that acts as a conduit for drilling fluid that is pumped from the surface through an attached drill string. Body 102 includes a number of legs 108, preferably three with attached cutters 110. Each cutter 110 comprises a cone shell 111 and rows of cutting elements 112, or teeth. The teeth may be tungsten carbide inserts (TCI) or milled teeth, as is generally known in the art.

Bit body 102 and cutters 110 rotating on bearing shafts (not shown) define a longitudinal axis 200 about which bit 100 rotates during drilling. Rotational or longitudinal axis 200 is the geometric center or centerline of the bit about which it is designed or intended to rotate and is collinear with the centerline of the threaded pin connection 106. A shorthand for describing the direction of this longitudinal axis is as being vertical, although such nomenclature is actually misdescriptive in applications such as directional drilling.

Bit 100 includes directional nozzle retention bodies 130, also called directional Q-tubes, about its periphery preferably in locations defined between adjacent pairs of legs 108. Nozzle retention body 130 of bit 100 includes an inlet 230 (shown in FIG. 2B), an outlet nozzle receptacle 202 appropriate for insertion of a fluid nozzle, a lower load face 134, and an upper sloped portion 139. Load face 134 includes a plurality of apertures where hardened elements 136 are preferably installed. Other hardened elements 135 are located on the upper sloped portion 139 of nozzle retention body 130. Hardened elements can be made of natural diamond, polycrystalline diamond, tungsten carbide, or any other suitable hard material. They may also be of any suitable shape. The profile or load face 134 of the nozzle retention body 130 need not be straight, but may be tapered, curved, concave, convex, blended, rounded, sculptured, contoured, oval, conical or other. The hardened elements could also be replaced with a wear-resistant material that is weldably bonded to load face 134. The outer surface may also be off-gage (i.e. its outermost portion extends short of substantially the full diameter of the drill bit) or on-gage (i.e. its outermost portion extends to substantially the full diameter of the drill bit) in whole or in part, according to the downhole application.

Nozzle retention body 130 directs drilling fluid flow from the inner bore or plenum 13 of drill bit 100 in any desired angle. Thus, an important aspect of the preferred nozzle retention body is the angling of the outlet nozzle receptacle 202, as shown more clearly in FIGS. 2A and 2B. Because the vector angles of the nozzle outlet 202 can be vectored in any direction, the bit hydraulics can be directionally optimized to perform specific function with relative ease and low costs. For example, the vector angle may be directed radially outboard to the hole wall or radially inward to the center of the bit. The vector angle may also be a lateral vector angle toward the trailing cone or leading cone. The vector angle could be a combination of vectoring the nozzle receptacle both radially and laterally in a compound angle. Furthermore, the fluid exit angle may include contributions from the vector angle of nozzle receptacle and the vector angle of a nozzle having a discharge not aligned with the vector angle of the nozzle receptacle. Thus, in a sticky shale formation prone to bit balling the most advantageous angling of drilling fluid may be over the trailing side of a drill bit cone, resulting in enhanced cleaning of the cone surface. In a hard formation, chip removal is thought to be a primary concern, and thus the most advantageous angling of the drilling fluid may be over the leading side of the drill bit cone to enhance the flow of drilling fluid to the surface. Seal life may be improved if the fluid flow is directed to remove the buildup of formation from around the seal area 122. But regardless, given the incredible diversity of downhole variables such as weight on bit, revolutions per minute, mud type and weight, depth, pressure, temperature, and formation type, the ability to easily construct drill bits that can direct fluid from nozzle retention bodies at angles disposed from the longitudinal will be of great value to drill bit designers and engineers.

It is expected that the ability of drill bit designers to utilize a set of angled nozzle receptacles on a drill bit, with each nozzle receptacle canted at a different angle, will result in new designs and improvements in downhole cleaning from the ability to obtain consistent and desirable fluid flow patterns at the bottom of the wellbore. In fact, a set of variously angled directional nozzle retention bodies, combined with angled or non-angled nozzles and/or min-extended nozzles, promises to offer significant improvements in drill bit performance. To further enhance performance, the nozzle retention body 130 may be centered or offset closer to either the leading side or the trailing side of the leg.

Figure 2A:
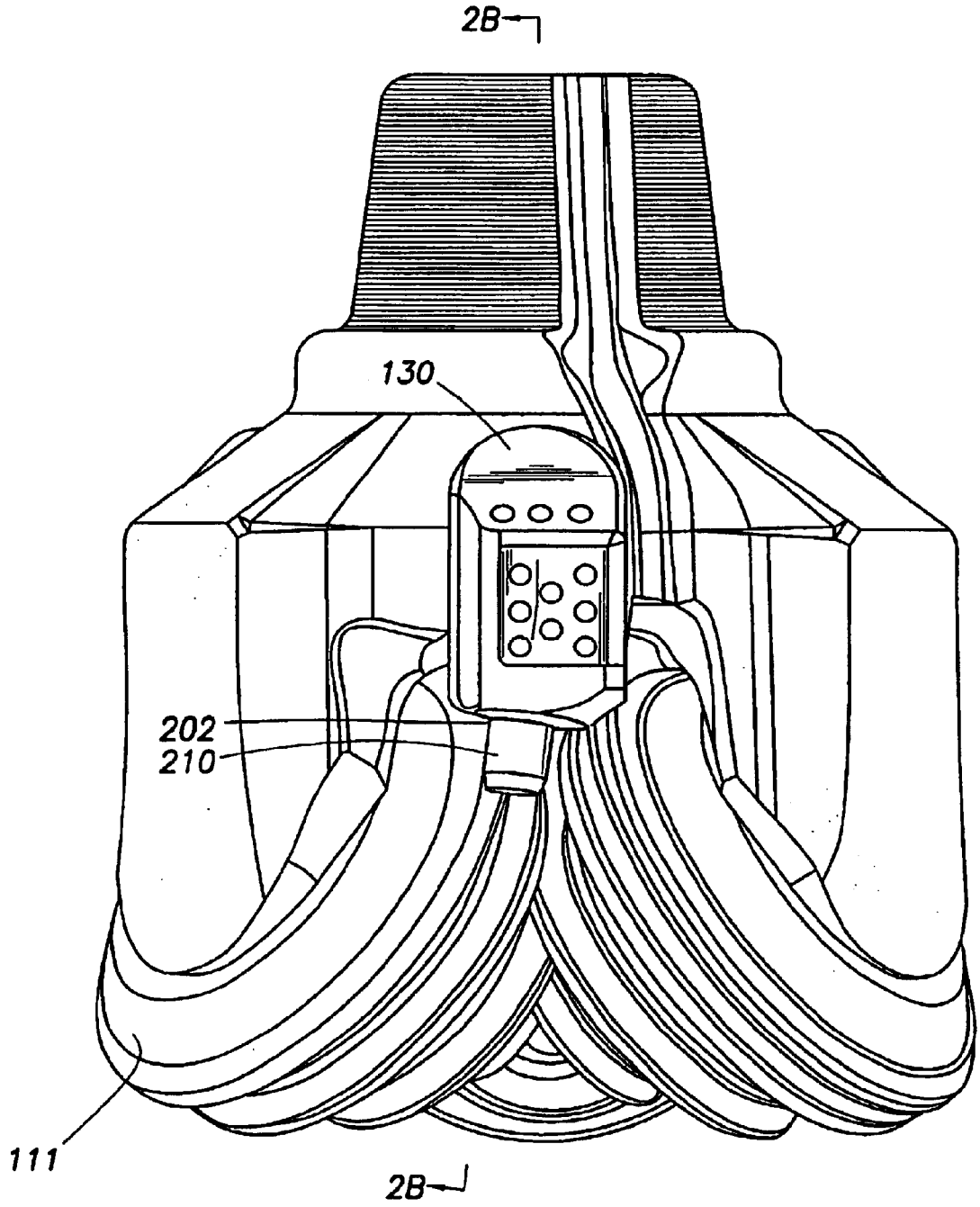
FIG. 2A is a perspective view of a rock bit with an angled nozzle retention body and a mini-extended nozzle.
Figure 2B:
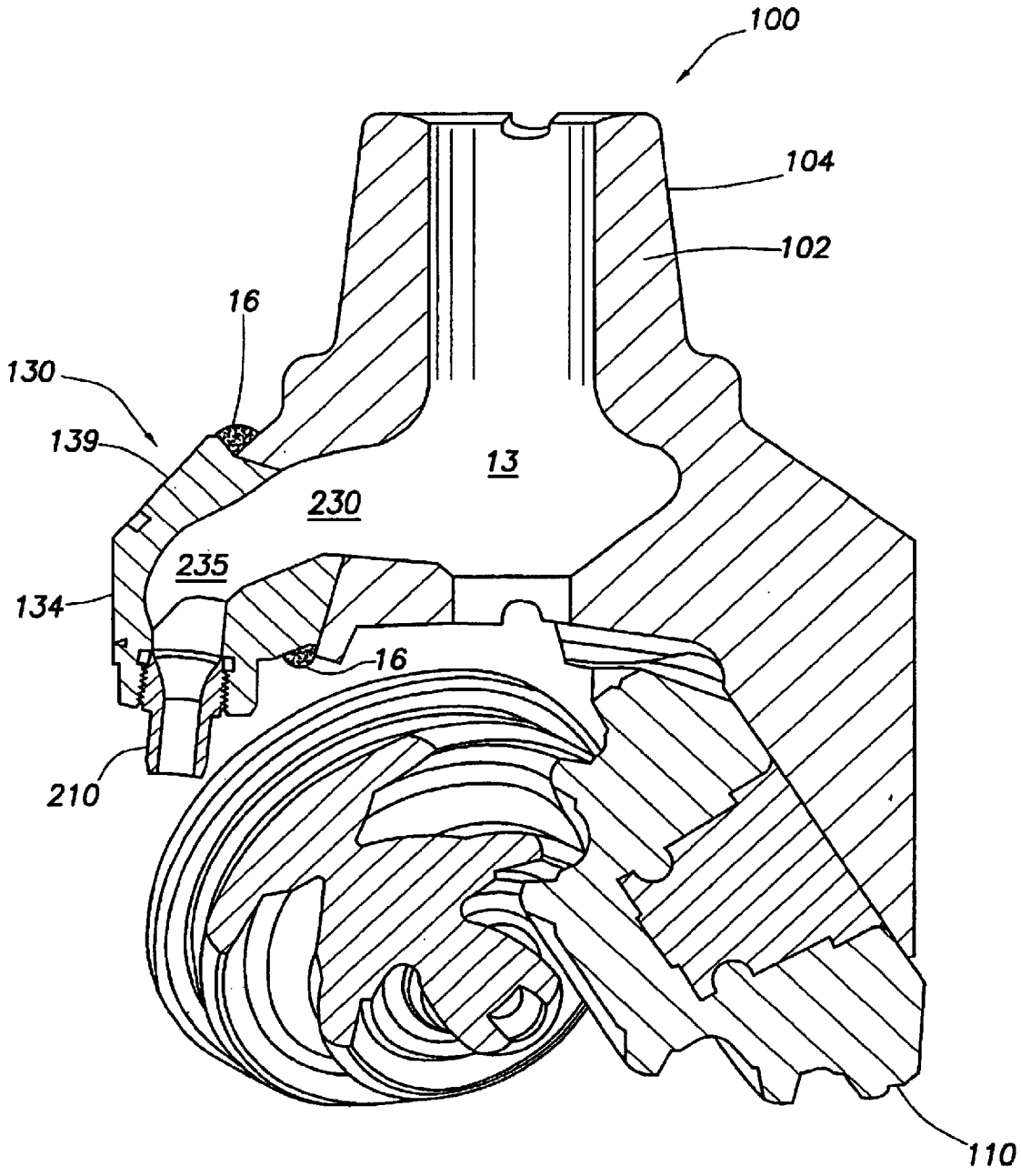
FIG. 2B is a cut-away view taken along line A—A of FIG. 2A.

FIG. 2A shows a drill bit with attached nozzle retention body 130. Mini-extended nozzle 210 is mounted in nozzle receptacle 202, and angles toward the trailing side of the cone shell 111. FIG. 2B is taken along line A—A of FIG. 2A.

FIG. 2B is a cross-sectional cut-away view of a nozzle retention body installed in the drill bit 100. The drill bit body 102 forms an interior fluid plenum 13 that transitions into the inlet 230 for the nozzle retention body 130. Nozzle retention body 130 includes an inner flowbore 235 that extends from the fluid inlet 230 to the nozzle 210. Nozzle retention body 130 retains a mini-extended nozzle 210 in the nozzle receptacle 202 by use of a nozzle retainer and o-ring, as is generally known in the field of mini-extended nozzles.

Since the nozzle retention body is relatively large, large streamlined passages may be formed in the body of the nozzle retention body. Further, because the nozzle retention body forms a part of the fluid plenum 13 in the drill bit, an enlarged streamlined opening internally of the weld interface is possible without major erosive discontinuities. The large passage and entrance to the nozzle retention body is desirable because it allows for greater fluid capacity by the nozzle retention body and reduces the erosion found in many previous fluid nozzles that have narrow fluid channels and sharp corners.

Figure 10:
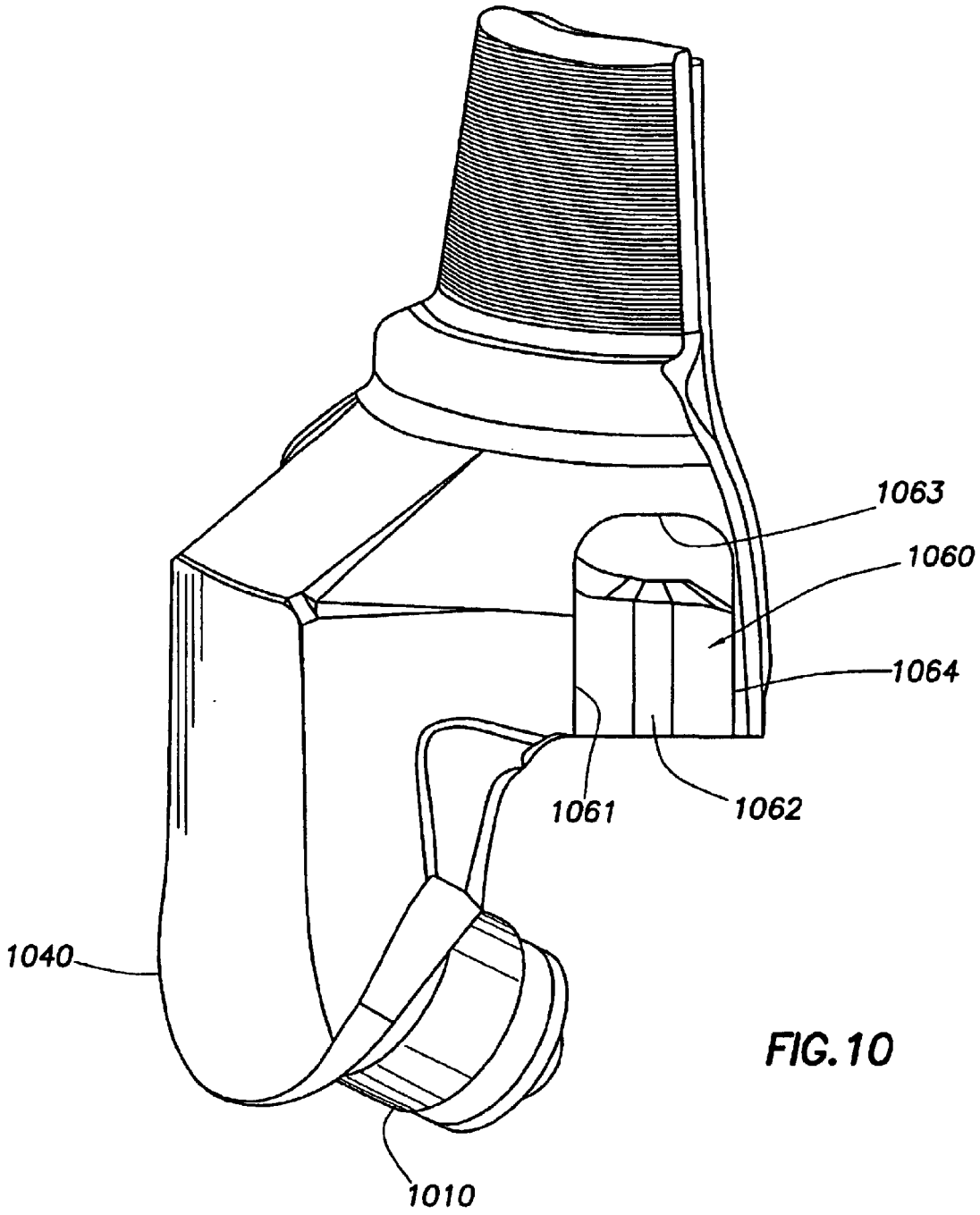
FIG. 10 is a partial drill bit body including a reception slot for a nozzle retention body.
Figure 11:
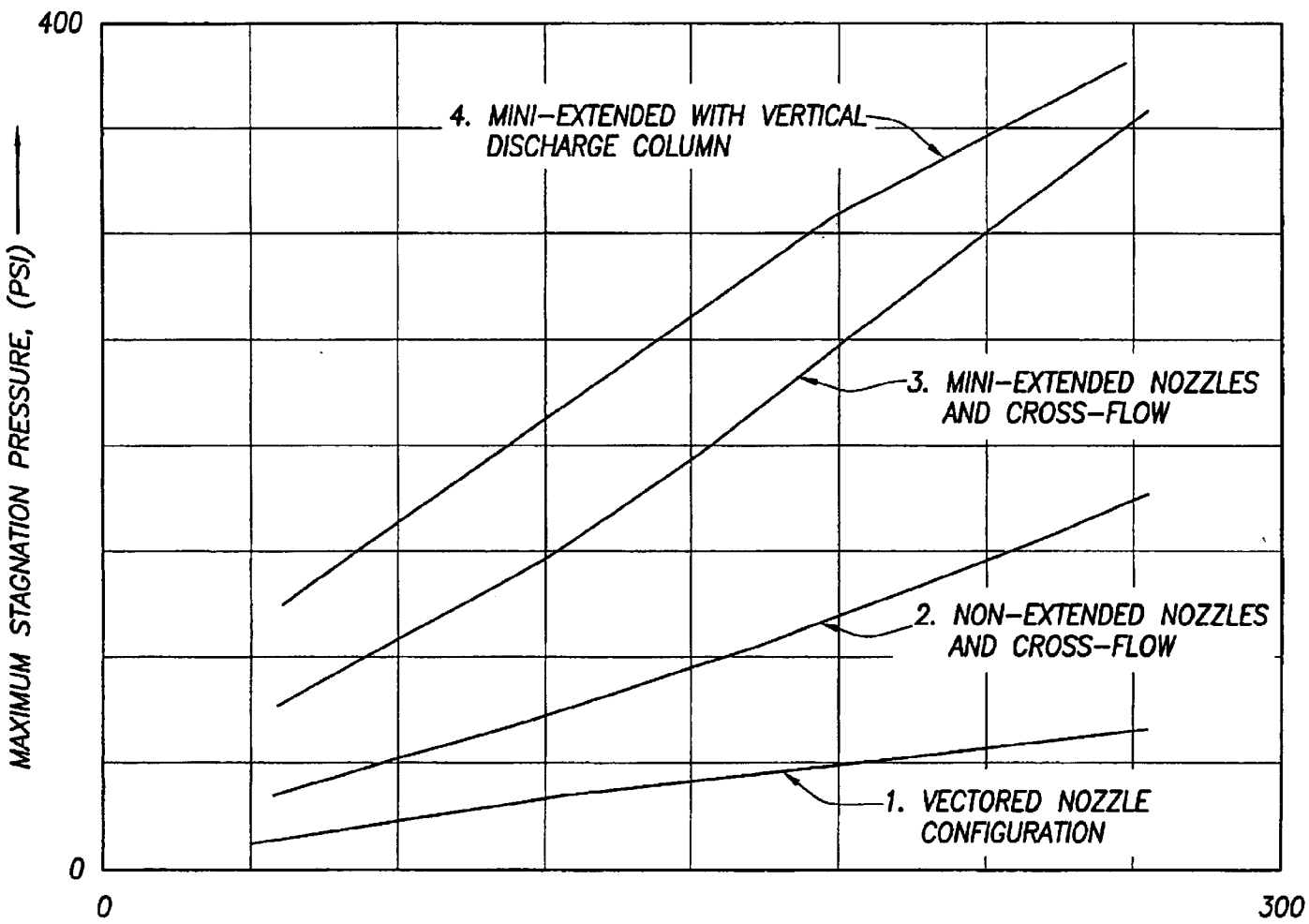
FIG. 11 is a graph showing a variety of impact pressure/flow rate relationships.

FIG. 10 shows a drill bit leg 1040 with a machined journal 1010, and a reception slot 1060 for insertion of nozzle retention body 130 machined into a second drill bit leg. Nozzle retention body 130 mounts to rock bit body 102 by a keyed engagement that snugly holds the nozzle retention body 130 to the large receptive aperture 1060 in the rock bit body 102. As used herein, the term "keyed engagement" means a single orientation engagement. Consequently, in a preferred embodiment, the reception slot is machined into the leg and includes four orthogonal surfaces 1061–1064. Surfaces 1061, 1064 correspond generally to left and right surfaces, surface 1062 corresponds generally to a back surface, and surface 1063 corresponds generally to a top surface. Once the slot is machined into the leg, it is a simple process for the directional nozzle retention body to be welded to the drill bit in its intended position. Of course, other reception slot 1060 designs can be used as long as the nozzle retention body 130 and the reception slot 1060 are matched preferably for a "keyed engagement." Referring back to FIG. 2B, a weld line 16 therefore attaches the nozzle retention body to the rock bit body 102 after the nozzle retention body has engaged the drill bit. The long peripheral edge of the nozzle retention body allows a lengthy exterior weld to be used to attach the nozzle retention body to the drill bit body 102. This lengthy weld 16 securing the nozzle retention body to the drill bit body 102 results in a very high strength bond for the nozzle retention body, with a high resistance to breakage. An internal weld (not shown) may also be included, but is not thought to be necessary.

Figure 3A:
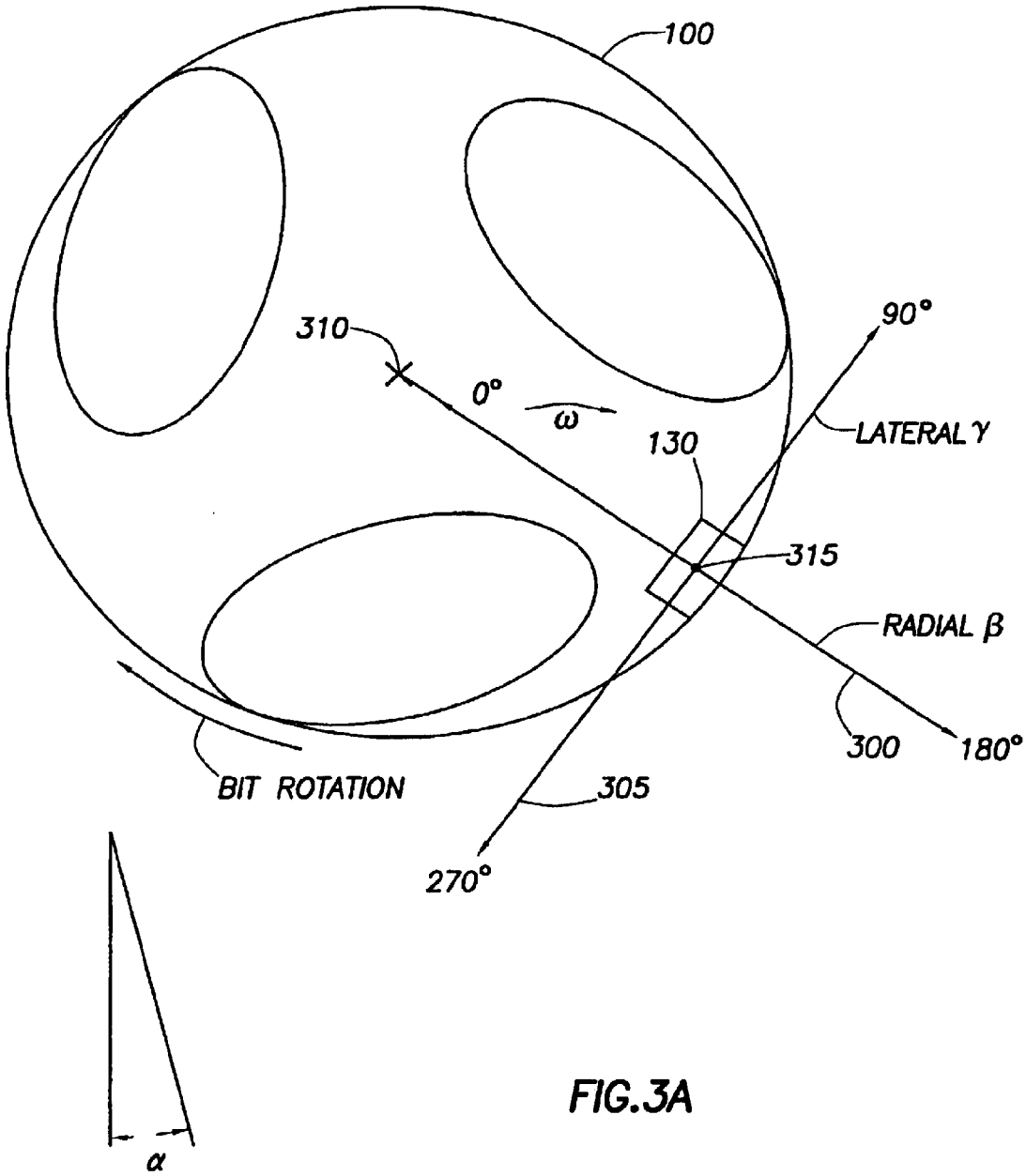
FIGS. 3A–3G are reference schematics defining directional angles for the nozzle receptacle.
Figure 3B:
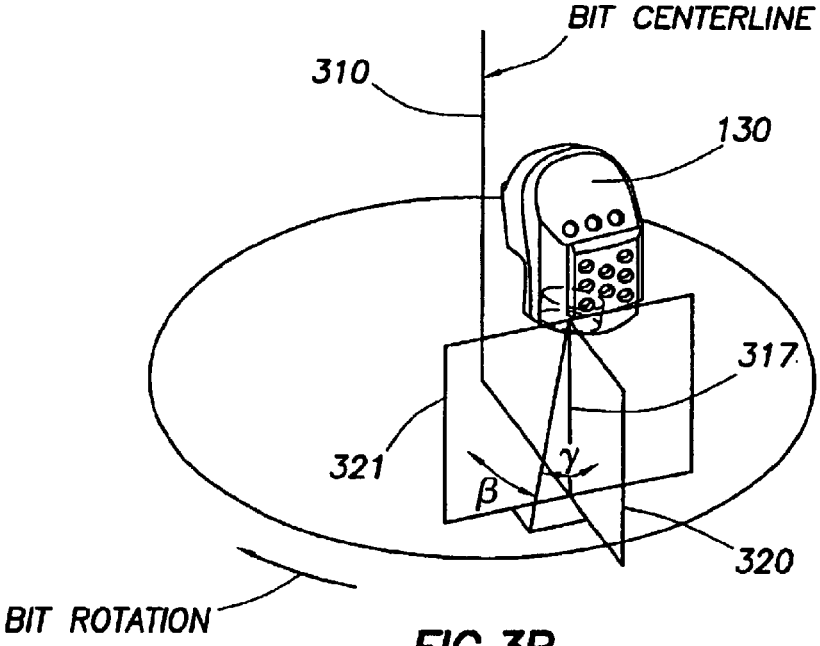

The exact direction of canting should also be defined. Referring to FIG. 3A, a top-down reference diagram is shown that defines the angular offset of nozzle receptacle 202. This diagram is not drawn to scale, but includes a drill bit 100 having three roller cones. Point 310 defines the centerline of drill bit 100, while point 315 defines the center of the nozzle receptacle at its exit. A reference line parallel to the longitudinal axis of the drill bit runs through point 315 and is called the nozzle receptacle centerline 317 (as shown in FIG. 3B). A radial reference line 300 defines the direction of the borehole wall directly away from the drill bit 100. A lateral reference line 305 is perpendicular to radial reference line 300. A lateral vector is positive when it points generally in the direction of bit rotation and generally toward the leading cone. Conversely, a lateral vector is negative when it points generally against the direction of bit rotation and toward the lagging cone. Radial reference line intersects point 310 in the center of the drill bit 100, and intersects a lateral reference line at point 315. A radial vector is positive when it points outward, toward the borehole wall. A radial vector is negative when it points inward toward the bit centerline. Thus, each canting or direction of the nozzle receptacle 202 may be defined as being some combination of a radial vector and a lateral vector.

Figure 3C:
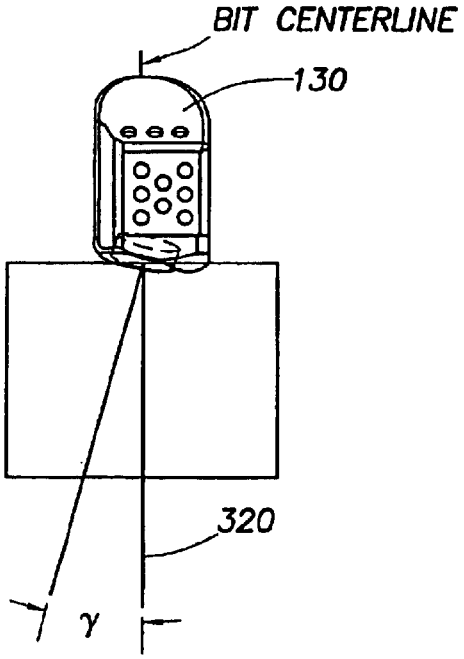
Figure 3D:
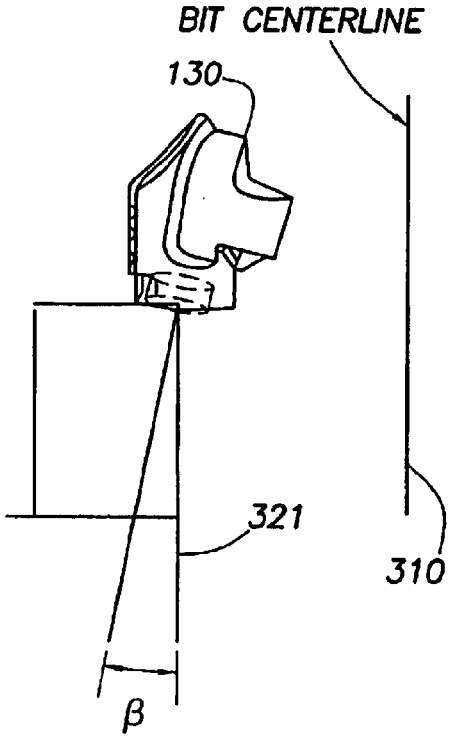

One example of this is shown in FIGS. 3B–3D. A nozzle retention body 130 is shown in FIG. 3B, with the direction of its nozzle being defined by two vector angles, $\gamma$ and $\beta$. Referring to FIGS. 3B and 3C, the angle $\gamma$ is a lateral angle defined with respect to a first plane 320. Plane 320 is formed by the bit centerline 310 and the nozzle receptacle centerline 317. In other words, the true angle $\gamma$ may be referenced from a straight ahead view of the nozzle retention body 130 as shown in FIG. 3C. Positive $\gamma$ angles direct the fluid in direction of rotation of the bit while negative $\gamma$ angles direct the fluid against the rotation of the bit. A $\gamma$ angle of zero degrees directs the fluid within the radial reference plane 320.

Referring now to FIGS. 3B and 3D, the angle $\beta$ is defined by a second plane 321 that lies perpendicular to the first plane 320 and that intersects the first plane at 317, the nozzle receptacle centerline. In other words, the angle $\beta$ may be referenced from the side view of the nozzle retention body shown in FIG. 3D. Positive $\beta$ angles direct the fluid in the direction of hole wall while negative $\beta$ angles direct the fluid toward the center of the bit. A $\beta$ angle of zero degrees directs the fluid within the lateral reference plane 321. When both the $\gamma$ and $\beta$ angles are zero degrees, the drilling fluid is directed parallel to the center line of the bit toward the hole bottom. A $\gamma$ angle range ±60 degrees and a $\beta$ angle range of −90 to +60 degrees can improve bottom hole cleaning by giving the bit designer the ability to direct the jet direction under the bit. A $\gamma$ angle of 110 to 250 degrees can provide improved cuttings removal by directing the fluid with a vector component moving toward the surface. This type of configuration is commonly known in the industry as an upjet. Angled upjets may have the benefit of optimizing the jet direction with the rotation of the bit such that the cuttings are more optimally removed from the proximity of the bit. While these vector angles have benefit based on current design philosophies, other angles certainly may show benefit in the future. As such, a major benefit of this attachable body design is that the angles can be readily changed to meet the future needs of the engineers without large impacts on the leg forgings.

Referring back to FIG. 3A, alternately, the direction and magnitude of the nozzle receptacle may be defined in a conical coordinate system as a combination of two angles, $\omega$ and $\alpha$. Referring to the radial reference line 300, an angle $\omega$ of 0° lies toward the center of the drill bit, with an angle $\omega$ of 180° lying in the direction of the borehole wall. An angle $\omega$ of 90° points in a direction collinear with the lateral reference line in a direction generally toward the lagging cone of a three cone rock bit. Likewise, an angle $\omega$ of 270° lies collinear with the lateral reference line in a direction generally toward the leading cone. The severity of the canting in a particular direction is defined by the second angle, $\alpha$. Angle $\alpha$ is defined with respect to the nozzle receptacle centerline, a vertical (i.e. parallel to the longitudinal axis of the drill bit) axis of the nozzle retention body running through point 315, the center of the nozzle receptacle. The nozzle receptacle centerline may also be referred to as the fluid outlet centerline.

Figure 3E:
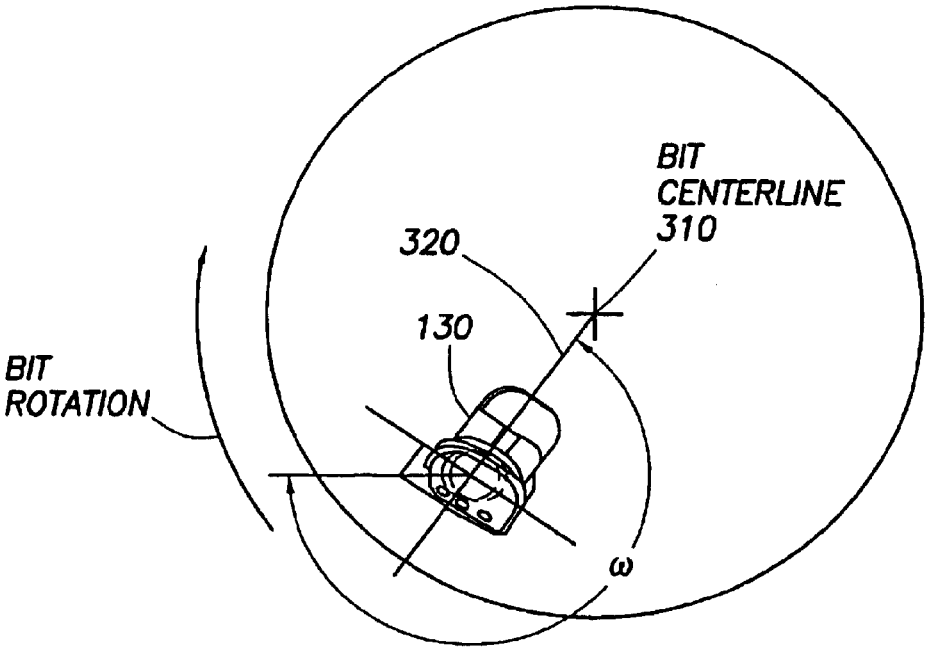
Figure 3F:
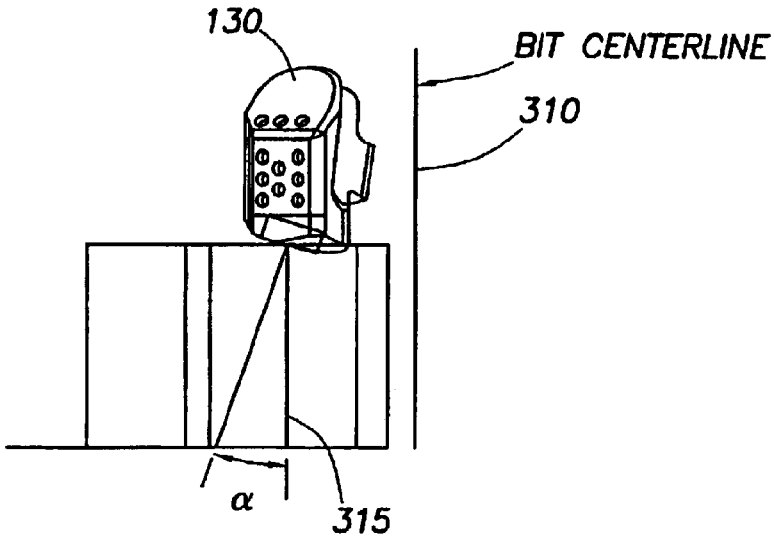
Figure 3G:
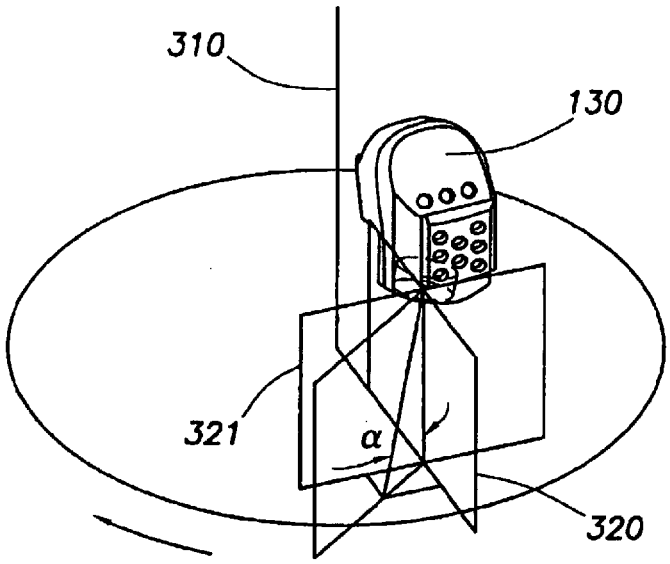

One example of this is shown in FIGS. 3E–3G. A nozzle retention body 130 is shown in FIG. 3A, with the direction of its nozzle being defined by two angles, $\omega$ and $\alpha$. Referring to both FIGS. 3A and 3E, the angle $\omega$ is defined with respect to the first plane 320 formed by the bit centerline and the centerline of the nozzle receptacle. In other words, the angle $\omega$ may be referenced from a top down view of the nozzle retention body 130 as shown in FIG. 3E. Referring to both FIGS. 3A and 3F, the angle $\alpha$ is defined by how far the nozzle receptacle 202 is canted or angled away from the nozzle receptacle centerline that is parallel to the bit centerline. FIG. 3G shows the combination of these two angles.

Figure 4:
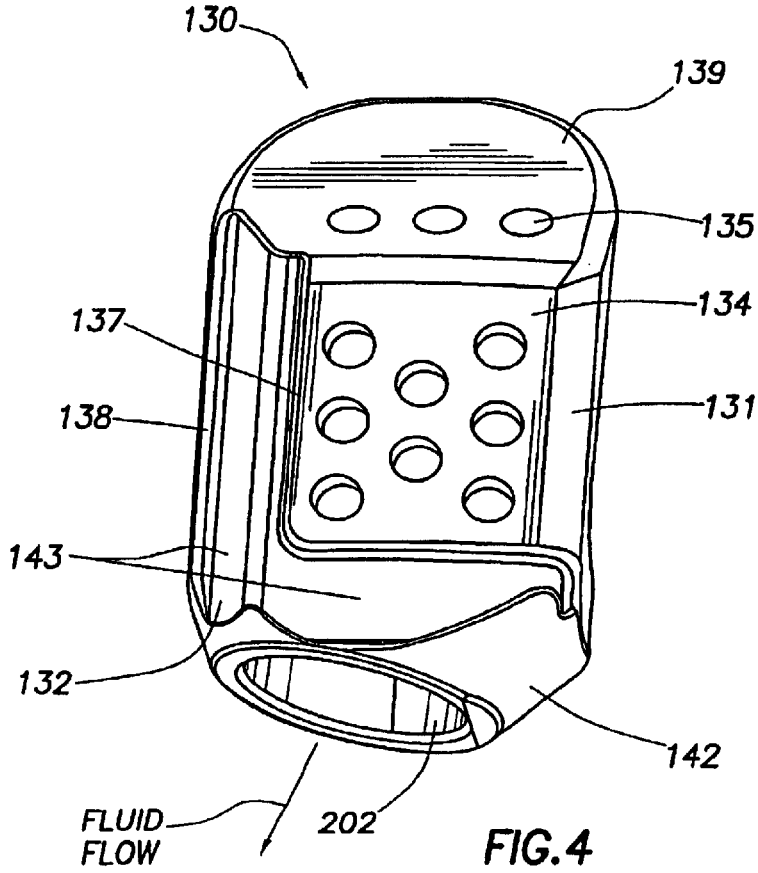
FIG. 4 is a close up view of a directional nozzle retention body.

Referring to FIG. 4, a close-up front view of nozzle retention body 130 is shown. Load face 134 is elevated from the remainder of nozzle retention body 130 as indicated by ledge 137. Nozzle retention body area 139 slopes away from load face 134 toward the body of the drill bit as shown in FIG. 1. Recessed area 143 is typically filled with an abrasion resistant material such as tungsten carbide or impregnated diamond to protect the nozzle retention body 130 during drilling operations. Ledges 138 and 137 provide a guide for the application of the erosion resistant material. Generally rounded surface 131 is machined on the lagging face of nozzle retention body 130, with welding ledge 138 and sloped area 132 being manufactured on the leading face of nozzle retention body 130. Because sloped area 132 is on the leading edge, sloped area 132 is preferably covered with hard facing to resist wear. Outlet nozzle receptacle 202 directs drilling fluid flow away from the nozzle retention body at an angle from longitudinal. The area proximate the outlet nozzle receptacle 202 is referred to as the nozzle retention body end 142 and may be chamfered, shaped, or contoured to provide reasonable clearance between the cutting structure and the nozzle retention body. This reduction in cross sectional area at the nozzle retention body end 142 allows the nozzle retention body end to extend closer to the wellbore bottom. This also allows a nozzle in nozzle receptacle 202 to be closer to the hole bottom while still maintaining the strength and robustness of the nozzle retention body.

Figure 5:
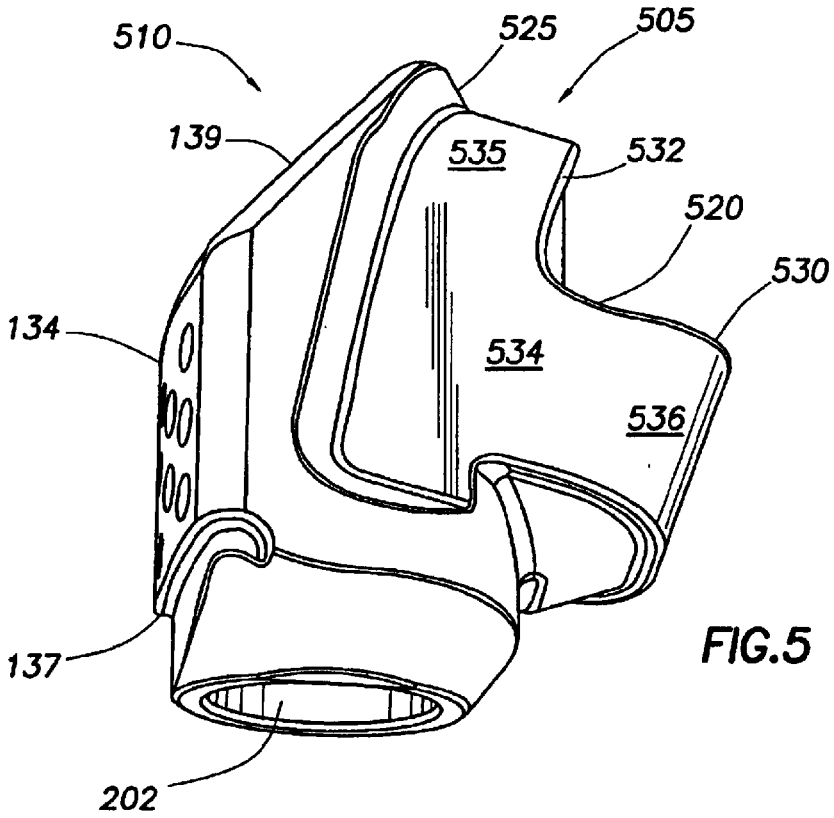
FIG. 5 is a side view of a directional nozzle retention body.

FIG. 5 is a side view of a nozzle retention body 130 separate from a drill bit. It generally includes an interior area 505 for insertion into the drill bit body 102, and an exterior portion 510 that remains outside the drill bit 100. Interior area 505 includes inlet 520 suitable as an entrance for drilling fluid from the plenum 13 of the drill bit 100. Inlet 520 is preferably defined by orthogonal lip surfaces 530 and 532. Flat surface 534 is preferably perpendicular to lip surfaces 530 and 532, and transitions into curved areas 535 (top) and 536 (rear). After insertion into the receptacle slot 1060, flat surface 534 and a corresponding flat surface (not shown in FIG. 5) on the opposite side of the nozzle retention body engage with surfaces 1061, 1064.

Exterior portion 510 includes load face 134 elevated by ledge 137, angled face 139 and a nozzle receptacle 202 for receiving the outlet nozzle. Nozzle retention body interface 525 connects the interior portion 505 and the exterior portion 510 of the nozzle retention body 130. Nozzle retention body interface 525 and curved areas 535 and 536 form the hard surfaces that abut the drill bit body when nozzle retention body is inserted into the drill bit 100.

Figure 6:
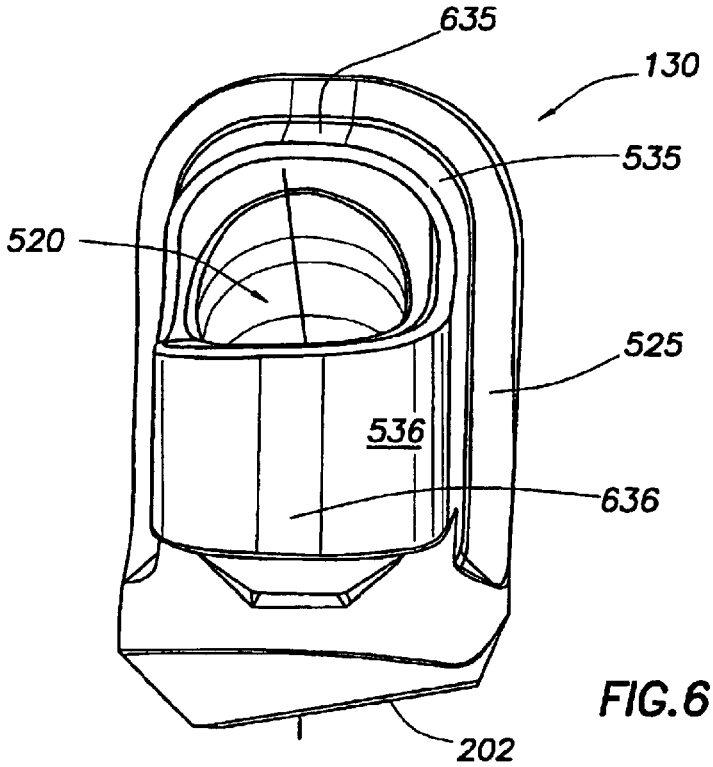
FIG. 6 is a rear view of a directional nozzle retention body.

FIG. 6 is a rear view of directional nozzle retention body 130. While depicting elements of the nozzle retention body such as surfaces 525 and 536, and nozzle receptacle 202, its most noticeable feature is the large inlet chamber 520. The size of this inlet chamber 520 reduces fluid turbulence and increases drill bit performance. Also shown are flat surfaces 635 and 636. Curved area 535 transitions into flat surface 635 at the top of the nozzle retention body. Flat surface 635 engages with reception slot top surface 1063 upon the engagement of the nozzle retention body into the reception slot 1060. Curved area 536 transitions into flat surface 636 at the back of the nozzle retention body. Flat surface 636 engages with reception slot rear surface 1062 upon the engagement of the nozzle retention body into the reception slot 1060. Each of surfaces 635 and 636 are preferably perpendicular to surface 534 shown in FIG. 5.

Once the slot is machined into the leg, it a simple process for the Q-tube to be welded in the bit in its correct position. This will be especially beneficial at the local drilling areas where local machine shops can machine the slot on a finished bit and weld the Q-tube in position with a high confidence the nozzles are directed at the correct location on the bit. Many other types of slot designs could be used. The only criterion is that the slot should key or fix the position of the attachable body to the leg such that the vectored fluid passage within the confines of the attached body are directed to their prescribed locations.

One benefit of the nozzle retention body 130 as shown in the Figures is that the opening formed in the drill bit body 102 if much larger than the drilled bore used when drilling the nozzle receptacle directly into the leg forging. The reduced cross-section of the standard nozzle receptacle is more susceptible to fluidic erosion, and has erosion-prone discontinuities, since the fluid accelerates into the reduced area of the jet bore and creates erosive turbulent recirculation zones. Since the nozzle retention body forms a portion of the plenum chamber and the pathway 235 from the plenum 13 to the nozzle 210 inlet is generally continuous, the erosive recirculation zones are minimized greatly reducing fluid erosion of the steel. Further, the nozzle retention body as shown has a keyed engagement between the nozzle retention body and the drill bit body. This simplifies the welding of the nozzle retention body 130 to the drill bit body 102.

Nozzle retention body 130 is preferably manufactured of a high strength material with good wear resistance for long life and durability. Nozzle retention bodies 130 may include enhancements such as hard facing or additional diamond cutter surfaces to improve overall performance of bit 100. Such hard facing can improve overall bit performance and reduce the possibility for nozzle retention body washout. Furthermore, nozzle retention body 130 flushes cuttings away from borehole bottom more effectively than before. Because of its massive construction and the chamfering or machining of its end, nozzle retention body 130 is able to relocate the nozzle receptacle 202 closer to borehole bottom without the worry or threat of breaking when impacted with high energy formation cuttings. The improvements mentioned above enable the useful life to drill bit 100 to be extended and can increase the effective rate of penetration when drilling wells.

Another advantage to the preferred nozzle retention body is its economical method of manufacture. It is preferred that the master casting mold of nozzle retention body 130 be manufactured without defining the specifics of the directional flowbore so that individualized nozzle retention bodies 130 can be manufactured for specific applications. This reduces the cost of manufacturing the directional nozzle retention body and allows for a wide range of angles.

Figure 7A:
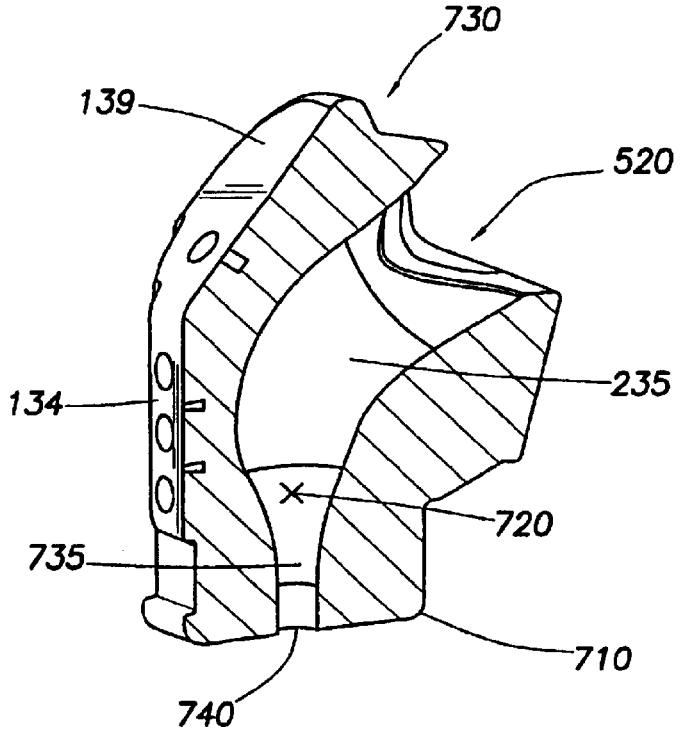
FIG. 7A is a side cut-away view of an unfinished nozzle retention body.
Figure 7B:
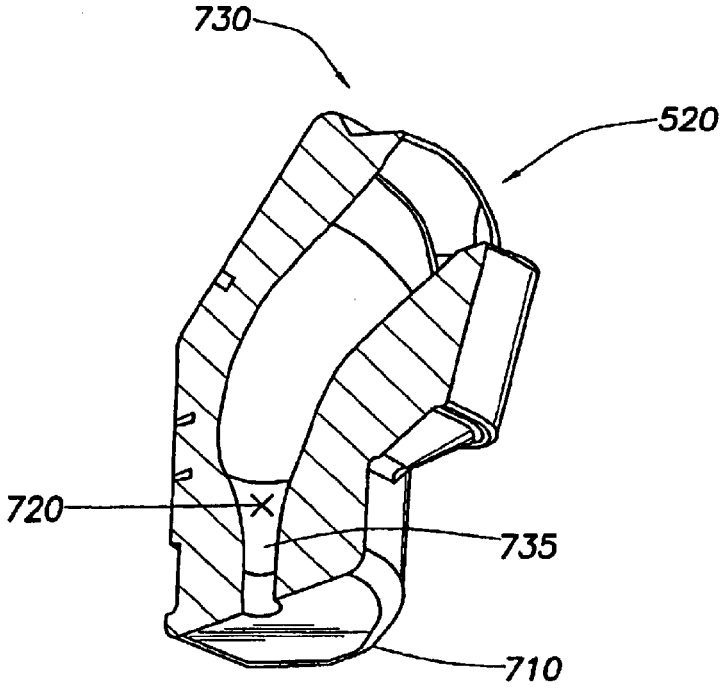
FIG. 7B is a side-bottom view of the unfinished nozzle retention body of FIG. 7A.

FIGS. 7A and 7B show a cross-section of an unfinished nozzle retention body 730 prior to any counterboring. Nozzle body receptacle 130 includes load face 134 and sloped area 139, as well as large inlet entrance 520 and the upper portion of the inner flowbore 235. However, as the inner flowbore transitions toward the lower end 710 of the generic nozzle retention body 730, it narrows into passage 735. Passage 735 also includes an "X" in its length, indicating the approximate location of a "pivot point" 720. Passage 735 continues down to an exit hole 740 at the lower end 710 of the of unfinished nozzle retention body. As will be understood below, it is not essential to the invention that passage 735 continue below the pivot point 720 because the nozzle receptacle will be drilled into the unfinished nozzle retention body in any case. However, its presence may be desirable for manufacturing or other purposes. In addition, the lower end 710 of the generic nozzle retention body 730 is not yet chamfered and has a large, bulky profile.

Figure 8:
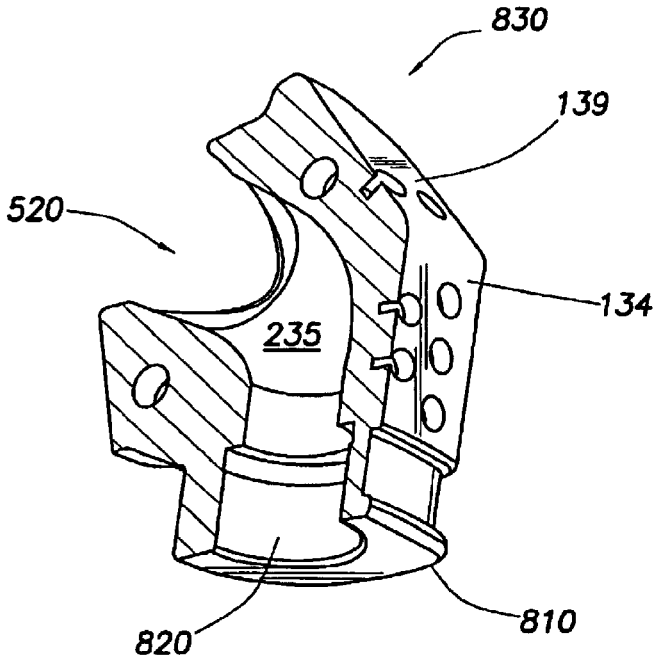
FIG. 8 is a cut-away view of a nozzle retention body.
Figure 9:
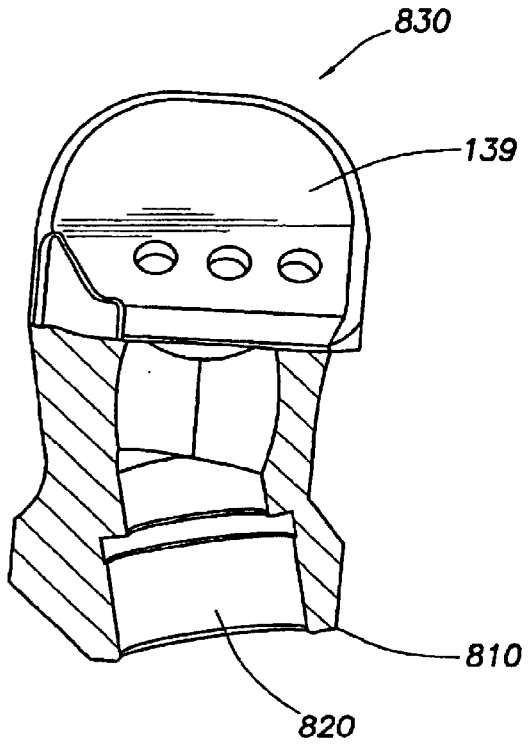
FIG. 9 is a front cut-away view of a nozzle retention body including an angularly disposed nozzle receptacle.

Referring to FIG. 8, a nozzle retention body 830 includes a large inlet entrance 520 proximate its upper end that transitions into a flowbore 235 and a nozzle receptacle passage 820 at the lower end 810. The generic nozzle retention body 730 of FIG. 7 is transformed into the nozzle retention body of FIG. 8 by means of counterboring a nozzle receptacle passage 820 into the lower end of the nozzle retention body. This counterbored passage 820 may be at any angle in a pre-selected range, but must intersect passage 235 to facilitate fluid flow. The necessary intersection of the counterbored nozzle receptacle and the passage 235 is expected to be accomplished by drilling toward the pivot point 740 until the two passages connect. The pivot point 740 is not necessarily an exact point, and indeed will vary slightly from nozzle retention body to nozzle retention body. Instead, it is a generalized universal target in passage 235, regardless of the angle of the counterbored passage. Of course, the counterbored passage 820 may be machined to the lower end 810 of the unfinished nozzle retention body by one or more than one steps, and there is not a specific need to have a universal pivot point pre-defined in the passage 235 (although this is expected to simplify manufacture of differently angled nozzle receptacles). Nonetheless, to simplify manufacturing a target pivot point 740 is expected to be predetermined, and may be found with relative precision on any particular generic nozzle retention body 730 by use of the perpendicular surfaces 530, 532, and 534. FIG. 9 shows the counterbored passage 820 canted at an angle to vertical.

An important feature of making the unfinished nozzle retention body be generic for a large range of angles is leaving sufficient mass at the base 810 of the nozzle retention body 730. It is only after the counterbore is drilled that the end of the nozzle retention body is chamfered or otherwise altered to minimize space requirements while maximizing strength.

While it would be most cost effective to use a single casting for all vector angles, the ranges of angles for a particular casting is limited by how the machined bore 820 and the cast bore 235 intercept each other. To cover a maximum range of angles, multiple casting may be required with each casting have a pre-defined range of lateral and radial angles that can be used to define the nozzle vector angle. However, with only a few castings, a broad range of nozzle vector angles can be accomplished providing a broad range of flexibility to the design engineer. The nozzle retention body may be of any length as long as it conforms to the interface 525 and fits within the design envelope of the bit body 102.

It is expected that the upper end of the unfinished nozzle retention body 730 will be manufactured for a keyed engagement with a drill bit 100. In particular, it is envisioned that a variety of different nozzle retention bodies 130 having different angled outlets may be brought to a drill site. Accompanying this array of nozzle retention bodies would be one or more drill bit bodies with suitable openings or apertures for receiving nozzle retention bodies, but with the nozzle retention bodies as yet uninstalled. Depending on the particular conditions in the borehole, particular nozzle retention bodies may be selected and welded to the drill bit on-site. Because a keyed mounting is preferred, the welding process is simplified and error in the exact exit flow angle for a nozzle retention body is much less likely. This results in an external weld of sufficient strength to withstand downhole forces. An interior weld may be added if, for example, the nozzle retention body is mounted before assembly of the legs of the drill bit. The flexibility to assemble a tailored drill bit on-site is thought to be highly desirable given the unpredictability of conditions downhole.

Nonetheless, this method of manufacturing a nozzle retention body 130 having an angled nozzle retainer 220 could be applied to nozzle retention bodies having engagements other than keyed, such as rotating or ball-and-socket-like engagements because a beauty of this method of manufacture is the machining of a nozzle receptacle in the lower end of the generic and unfinished nozzle retention body. As explained above, however, the keyed attachment for the nozzle retention body is preferred.

Thus, a preferred embodiment of the invention overcomes many of the problems of the prior art by using a weldably (or otherwise) attachable body and a machined slot in the bit body that allow the attachable body to be placed in the bit in only one orientation. The nozzle receptacle machined in the attachable body or Q-tube is drilled at an angle providing the flexibility to change the directionality and placement of the nozzle centerline and exit bore. A special casting is designed that allows for the nozzle receptacle to be machined into the attachable body with a broad range of vector angles to account for the application specific requirements while keeping the installation of the Q-tube the same for all (since the interface slot has not changed and positionally fixes or keys the attachable body in the leg).

However, although the flexibility provided by a nozzle retention body with a canted discharge port is expected to greatly assist drill bit design, the invention includes another approach to achieving design flexibility and favorable hydraulics. As noted above, the nozzle retention body may be offset closer to either the leading side or the trailing side of the leg (this may also be referred to as lateral translation), and the fluid may be discharged at any desired angle. When an embodiment of the invention includes a laterally-translated fluid discharge column that is within a distance of 3% of bit diameter to the cutting elements on a rolling cone, improved cone cleaning results. Where the fluid column is vertical (i.e. parallel to longitudinal axis of drill bit) or generally parallel to bit centerline (within 3 degrees of parallel to longitudinal axis of drill bit), it is believed to result in the high fluid impact pressures of a vertical fluid discharge column. The combination of these features is believed to be particularly effective.

Figure 12:
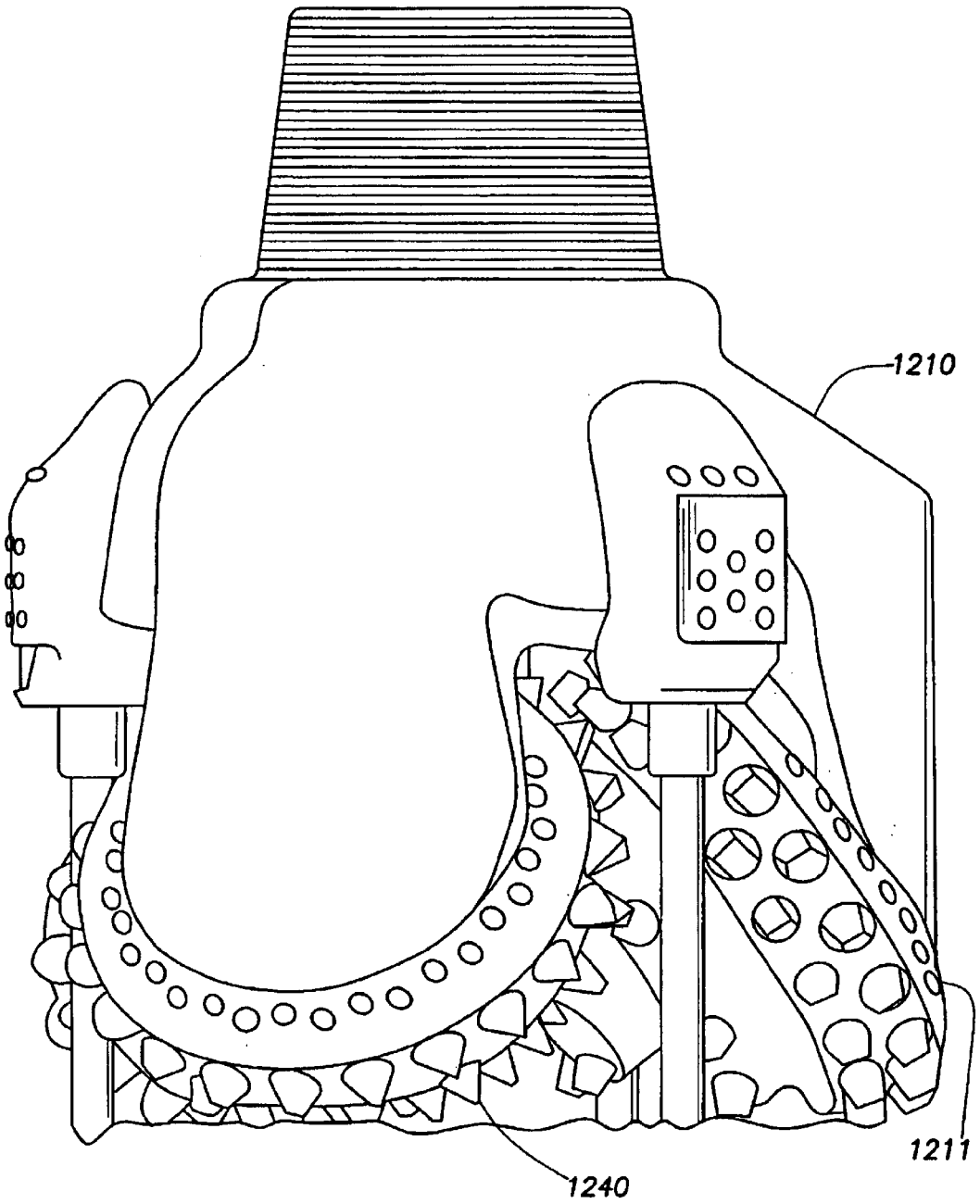
FIG. 12 (PRIOR ART)
FIGS. 12–14 are views of a prior art nozzle retention body.
Figure 13:
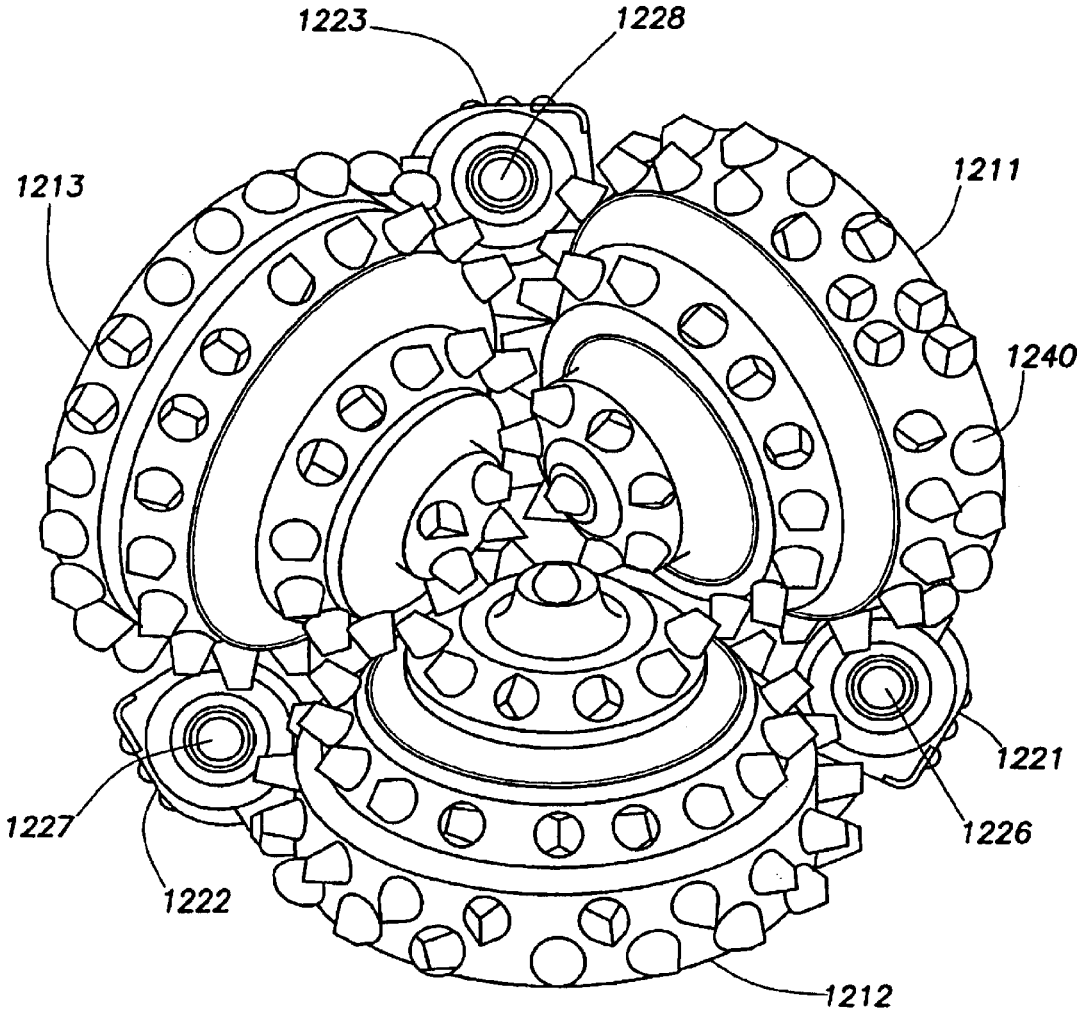
FIG. 13 (PRIOR ART)
Figure 14:
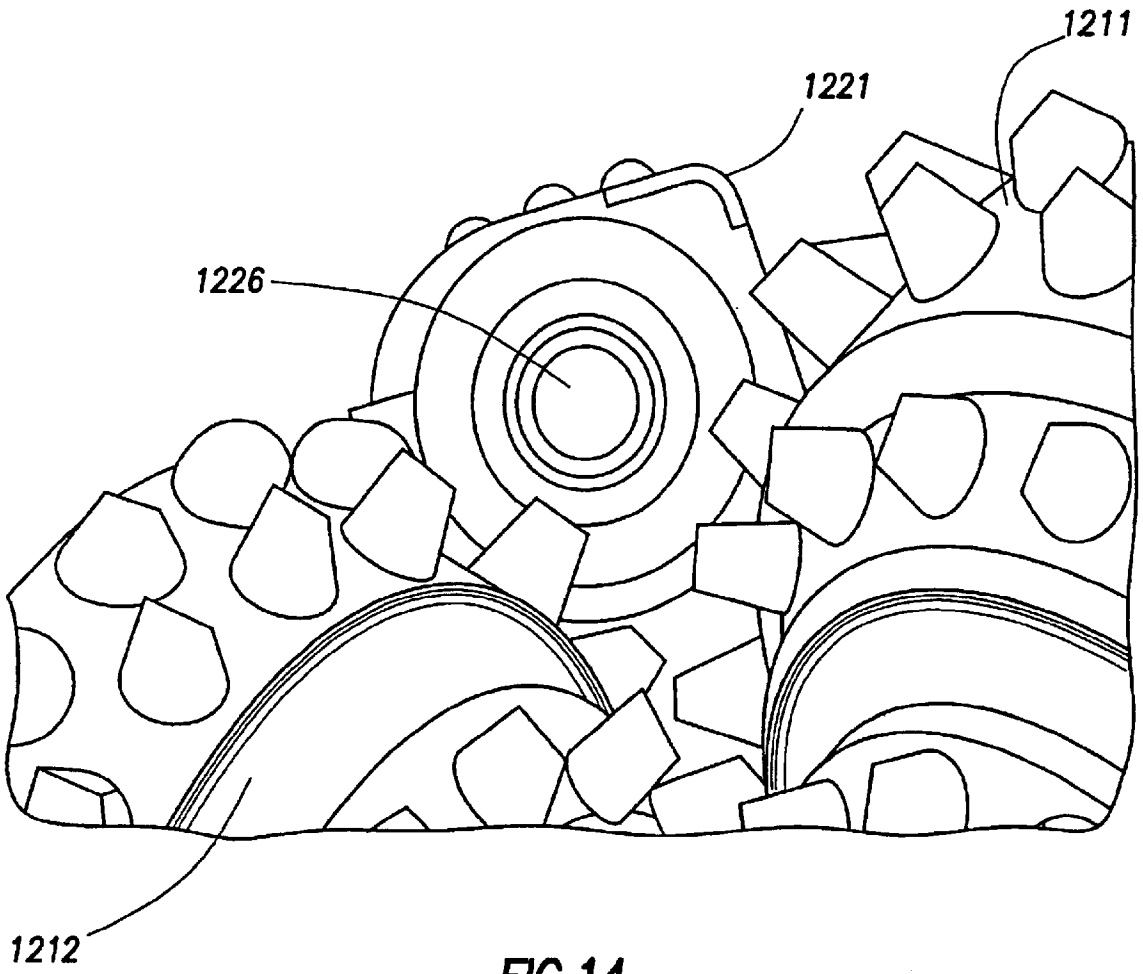
FIG. 14 (PRIOR ART)

FIGS. 12–14 are various views of a prior art nozzle retention body having a fluid discharge port that is not offset to a leading or trailing side of the drill bit. A drill bit 1210 includes three rolling cones 1211–1213. Between each pair of cones are nozzle retention bodies 1221–1223. As best seen in FIG. 12, each nozzle retention body 1221 includes a generally flat face region and a sloped upper portion, each with inserts, as explained generally above. Fluid discharge columns, exaggerated to illustrate their vertical direction, are also shown. As can best be appreciated from reference to FIGS. 13 and 14, each fluid discharge port 1226–1228 of the corresponding nozzle retention body 1221–1223 is located mid-way between adjacent cones 1211–1213. For example, the fluid discharge port 1228 of nozzle retention body 1223 is mid-way between cones 1211 and 1213. Since the high fluid velocity is far away from the inserts on the cones, this type of hydraulic configuration provides little cone cleaning.

Figure 15:
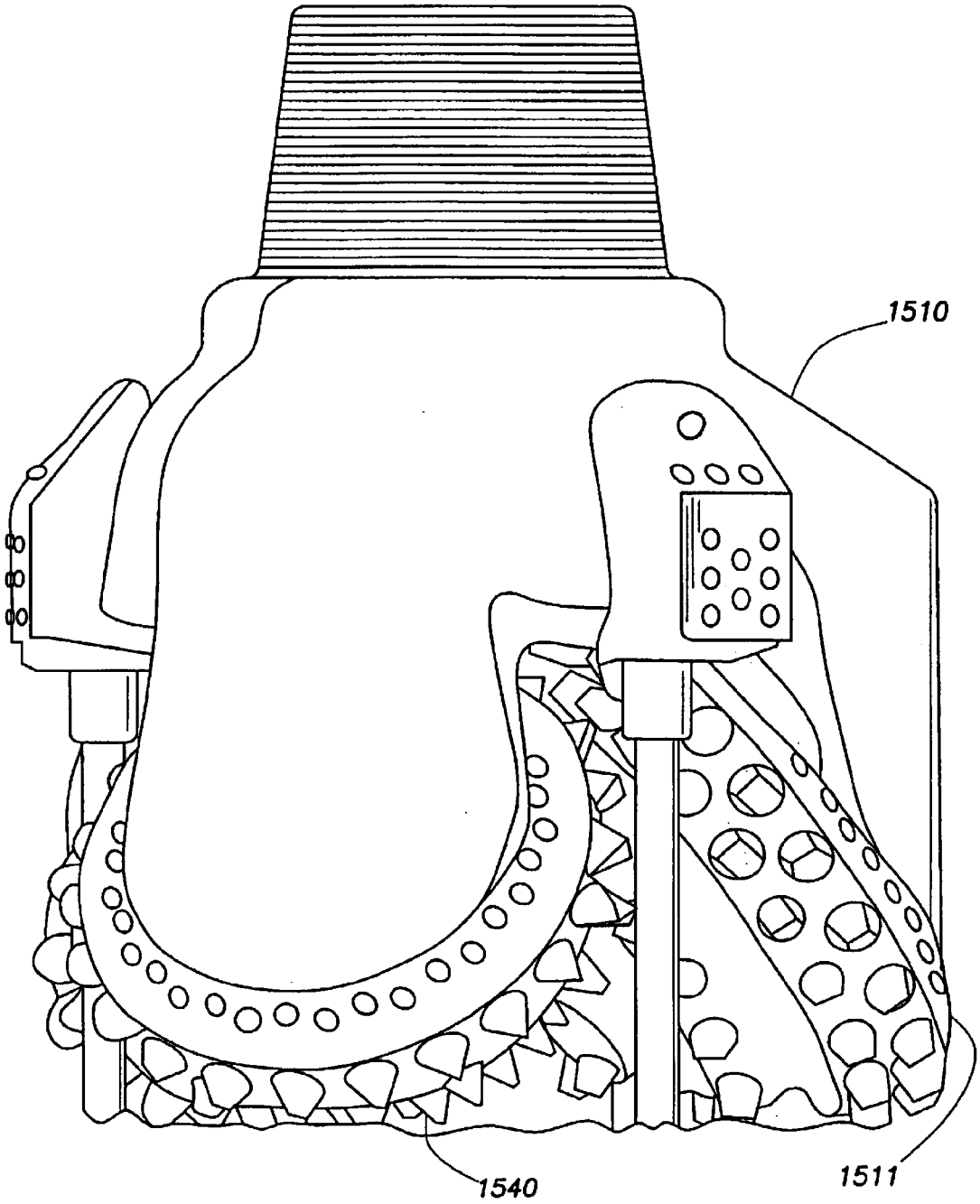
FIGS. 15–17 are views of a nozzle retention body in accordance with a preferred embodiment.
Figure 16:
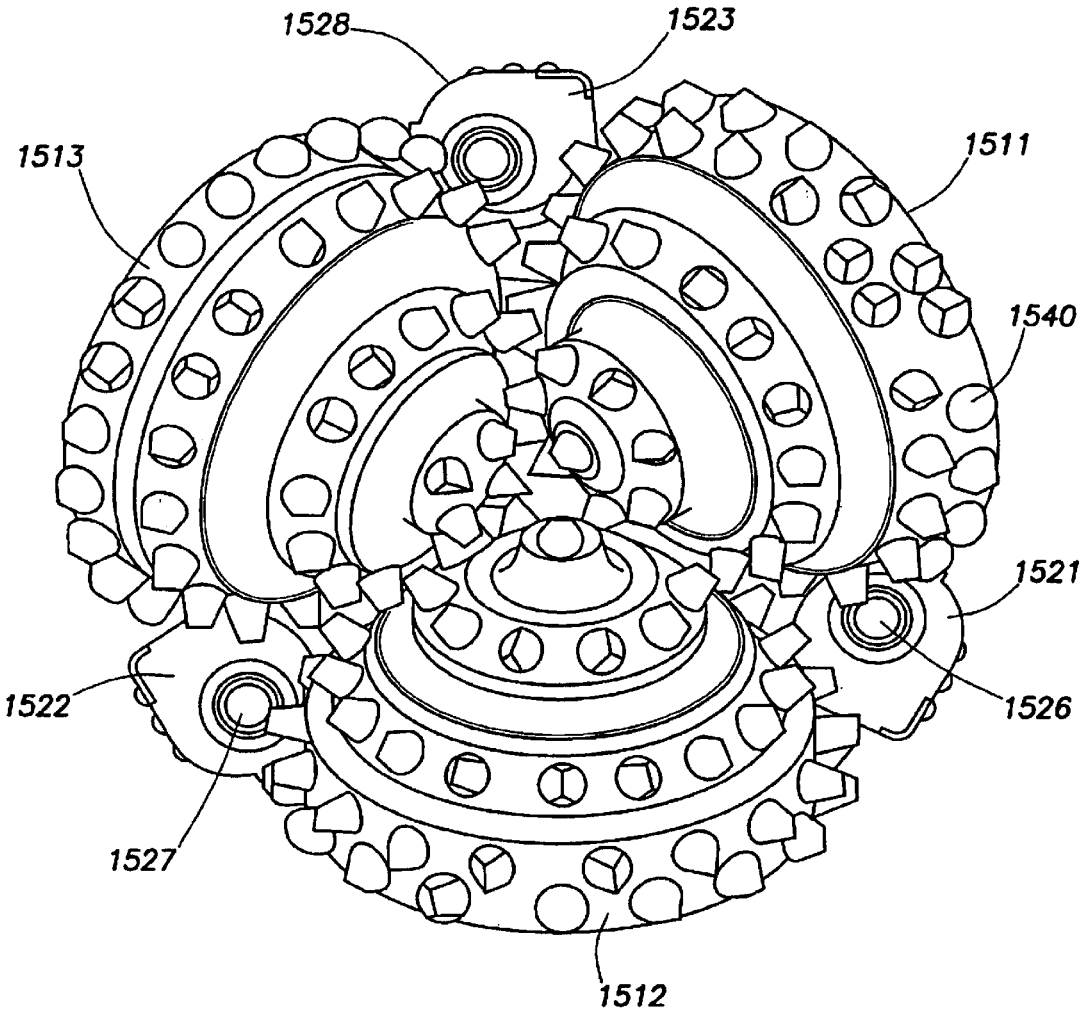
Figure 17:
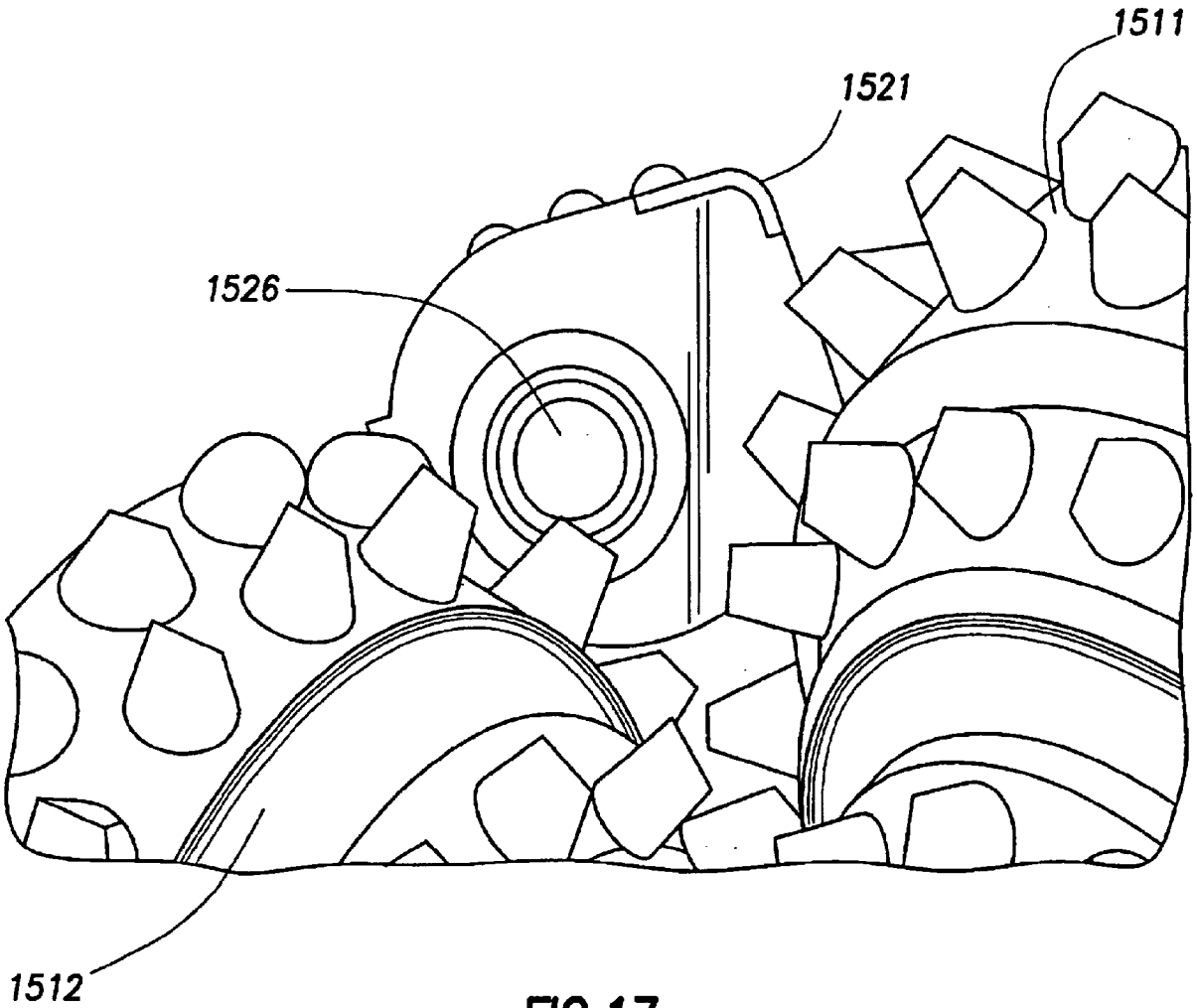

FIGS. 15–17 show various views of a nozzle retention body having a translated fluid discharge port offset toward one side of the drill bit, in accordance with an embodiment of the invention. A drill bit 1510 includes three rolling cones 1511–1513. Between each pair of cones are nozzle retention bodies 1521–1523. As best seen in FIG. 15, each nozzle retention body 1521 includes a generally flat face region and a sloped upper portion, each with inserts, similar in that respect to those explained generally above. Fluid discharge columns, exaggerated to illustrate their vertical direction, are also shown originating from the nozzle retention bodies and attached nozzles. As can best be appreciated from reference to FIGS. 16 and 17, each fluid discharge port 1526–1528 of the corresponding nozzle retention body 1521–1523 is located between adjacent cones 1511–1513, but closer to one of the cones than the other. For example, the fluid discharge port 1528 of nozzle retention body 1523 is much closer to cone 1513 than 1511.

The offsetting of the discharge port for each nozzle retention body can be made by use of a standard nozzle retention body (Q-tube) placed in a slot on the drill bit body, the slot having been machined to be laterally displaced. Also, the offsetting of the discharge port can be made by use of a nozzle retention body placed in a receiving slot at the standard location as known in the art, but with the portion of the nozzle retention body that defines the discharge port being translated either forward or back as shown in FIGS. 15–17.

Translation of the nozzle discharge port laterally, combined with a standard nozzle (i.e. straight), or other suitable nozzle results in a fluid column discharge from the nozzle parallel to the bit centerline and intersecting the cone inserts as they pivot about the leg journal (as generally shown in FIG. 15 although FIG. 15 does not show the fluid column expansion that an actual fluid discharge column undergoes). Since the high fluid velocity is very close and impacts the inserts 1540 on the cones, this type of hydraulic configuration is believed to provide excellent cone cleaning.

To understand the cleaning action that occurs downhole, a set of reference terms should be established. The degree of cone cleaning (as well as the risk of cone shell erosion) will correspond to the distance between a point on the roller cones on the drill bit and a point or area on the jet of drilling fluid ejected from the nozzle. With regard to the roller cones, the cones (and therefore the cutting elements) constantly rotate and move. Nonetheless, two measurement locations on the roller cone are of particular interest: 1) the closest location of the cone shell to the fluid jet; and 2) the closest point attained by tips of the cutting elements to the jet of drilling fluid. Two measurement locations of interest on the fluid jet are: 1) the projected fluid path for the fluid jet; and 2) the perimeter of the fluid jet.

Figure 18:
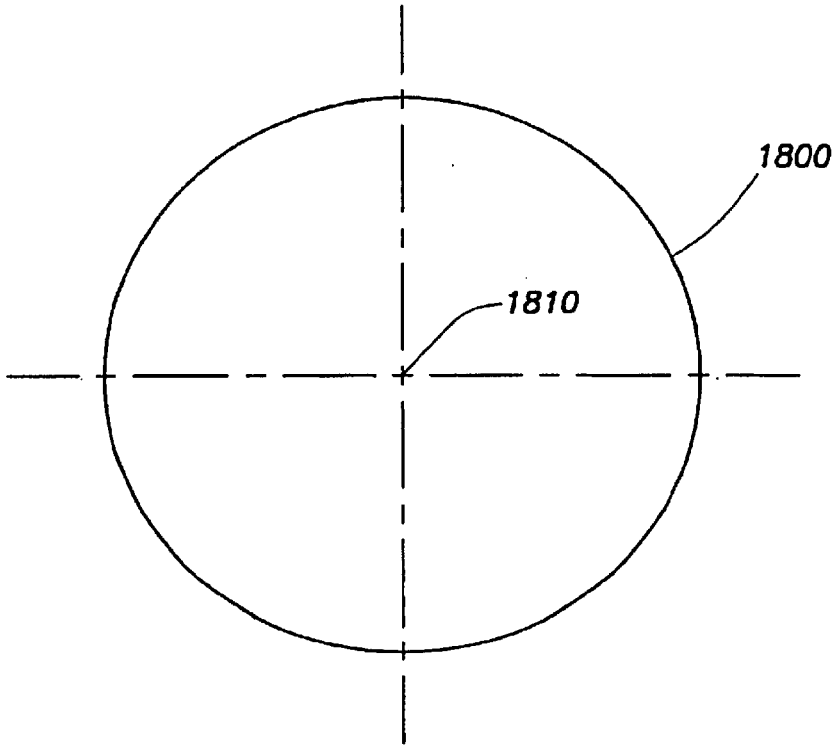
FIG. 18 is a straight-ahead view of a circular exit port.
Figure 19:
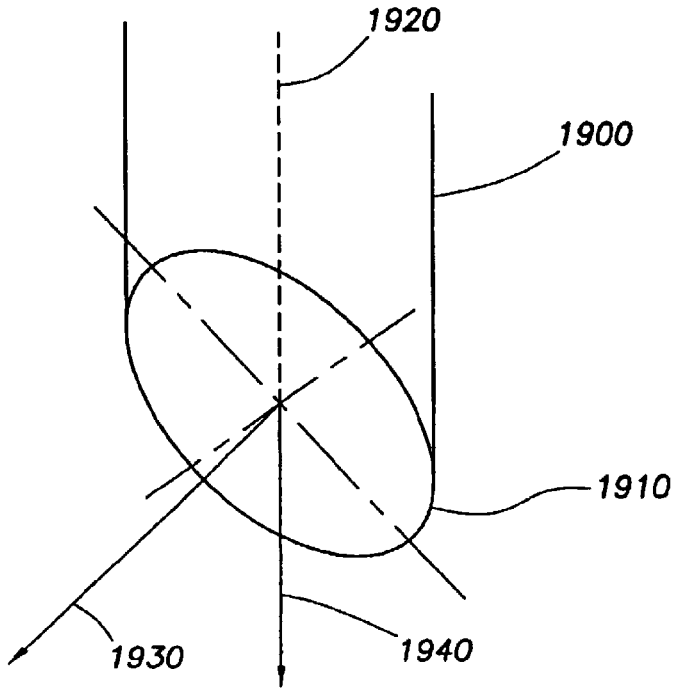
FIG. 19 is a view of an angle exit port showing projected fluid paths.

A geometric parameter called the "projected fluid path" may be found in one of three ways. First, the "face normal projected fluid path" is a line projected normal to the exit surface of an exit port to the nozzle attached to the nozzle retention body. For example, as shown in FIG. 18, if a nozzle has a circular exit port 1800, the centroid 1810 of the circle defined by the exit port is the center of the circle. The projected fluid path for this calculation would be a line perpendicular to the center of this circle (i.e. coming straight out of the page), regardless of the angle at which this circle is disposed to the longitudinal axis of the nozzle. In the case of an oval-shaped exit port for the nozzle, the centroid of the oval is its center. For example, FIG. 19 shows a nozzle 1900 with an exit port 1910 disposed at an angle relative to the longitudinal axis 1920 of the attachable device. The face normal projected fluid path 1930 is perpendicular to the angular face of the exit port.

The second way to determine the projected fluid path is the "parallel to centerline projected fluid path". This is a line projected from the centroid of the nozzle exit plane parallel to the centerline of the drill bit. For this calculation, a line projects from the centroid of the exit surface of the attachable device in a direction parallel to the bit axis centerline. Obviously, where a nozzle to the attachable device is disposed at a near-vertical angle, with the exit plane of the nozzle being perpendicular to the fluid flow as is standard, these two projected fluid paths are nearly the same. For the geometry shown in FIG. 18, the parallel to centerline projected fluid path is the same as the face normal projected fluid path. In FIG. 19, the parallel to centerline projected fluid path 1940 is different from the face normal projected fluid path 1930.

The third way to determine a projected fluid flow path is both the most accurate and the most complicated. Termed the "projected average fluid path", it takes into account the fluid behavior in order to determine directionality. To accomplish this task, some knowledge of the flow field is required through means such as computational fluid dynamics (CFD) and/or experimentation. Experimental methods for obtaining flow field data include laser velocimetery, probes, visual observation or other techniques. Typically however, these methods are usually quite expensive and time consuming. CFD, on the other hand, is particularly well suited for this type of analysis since direction and speed of the fluid can be readily determined within discrete elements in the flow field. For instance, the directionality of fluid at a nozzle exit can be determined by evaluating each element or sub-element (i.e. a face or node) of the fluid at the exit plane or exit surface of the nozzle. The first step is to combine all the directionality information of each individual element or sub-element of the nozzle exit into a form that is representative of all the fluid flowing through the nozzle exit. Known approaches include the basic arithmetic average to more complex calculations such as area-weighted averages, velocity-weighted averages, mass-weighted averages, and location-weighted averages. While each method provides an "average velocity vector" result, the nature of the flow field and how the flow field data was generated, may have significant effect on the similarity of the final results. To this end, the preferred method of calculation is by the mass-weighted average velocity vector, $\vec{V}_{AVG}$, as shown below.

$$\vec{V}_{AVG} = \frac{\int \vec{V}\rho\vec{V}\cdot d\vec{A}}{\int \rho\vec{V}\cdot d\vec{A}} = \frac{\sum_{i=1}^{n} \vec{V}_i\rho_i\vec{V}_i\cdot d\vec{A}_i}{\sum_{i=1}^{n} \rho_i\vec{V}_i\cdot d\vec{A}_i}$$

where, $\vec{V}_{AVG}$=Mass-weighted average velocity vector of the fluid flowing through the nozzle exit.

$\vec{V}$=Fluid velocity vector at an arbitrary location on the nozzle exit surface.

$d\vec{A}$=Elemental area of the nozzle exit surface at the arbitrary location.

$\rho$=Density of the fluid.

i=Subscript denoting element number, ranges from 1 to n.

n=Total number of elements on nozzle exit surface.

$\vec{V}_i$=Velocity vector at element i.

$\rho_i$=Fluid density at element i.

$d\vec{A}_i$=Surface area of element i.

The fluid directionality is then defined as the unit vector of the average velocity vector. It is calculated by dividing the average velocity vector by its magnitude. Now, to measure the angle between the average velocity unit vector and bit centerline, a unit vector describing the bit centerline has to be calculated. Customarily, it is assumed that the positive direction of one coordinate axes in a Cartesian system follows the bit centerline towards the hole bottom. Hence, the bit centerline unit vector lies on one of the principal axis. However, it is not mandatory to do so. Thus the unit vector of the average velocity vector is defined as $$\hat{u}_{AVG} = \frac{\vec{V}_{AVG}}{\|\vec{V}_{AVG}\|}$$

and the bit centerline unit vector is defined as $\hat{u}_{CL}$

Where, $\hat{u}_{AVG}$=Unit vector of the mass-weighted average velocity vector of fluid flowing through the nozzle exit.

$\hat{u}_{CL}$=Unit vector describing the bit centerline directed towards the hole bottom.

A vector analysis "dot product" can then be performed on the two unit vectors to determine the angle between the bit centerline and the average velocity vector.

$$\theta=\cos^{-1}(\hat{u}_{AVG}\cdot\hat{u}_{CL})$$

Where,

θ=Angle between the bit centerline unit vector, $\hat{u}_{CL}$, and the average velocity unit vector, $\hat{u}_{AVG}$.

Using this information, the preferred projected average fluid path is defined in this case by projecting the geometric centroid of the nozzle exit surface in a direction defined by the unit vector of the mass-weighted average velocity vector. Alternatively, the mass flow centroid can also be used as a starting point. It would be calculated in similar fashion as the geometric centroid, except the mass flow rate would be used as the basis to determine the centroid location instead of the physical exit area. The possible scenarios for vertical flow include: 1) both projected fluid paths and projected average fluid paths are parallel to bit centerline; 2) face-normal projected fluid path is not parallel to bit centerline, but average fluid path is parallel to bit centerline; and 3) face-normal projected fluid path is not parallel to bit centerline, average fluid path is not parallel to bit centerline, but at least a portion of the fluid is directed in such a way to provide vertical flow. The first instance of vertical flow might be accomplished by attaching a standard mini-extended nozzle to a preferred nozzle retention body. The second instance of vertical flow might be accomplished by attaching a standard mini-extended nozzle with an exit port truncated to the interior passage rather than perpendicular to the interior passage to a preferred nozzle retention body. The third instance of vertical flow might be accomplished by a lobed or multi-orifice nozzle attached to a preferred nozzle retention body.

The clearance distance from a projected fluid path to a location defined by the closest point on the inserts on the cone is used as the measurement of interest. This clearance distance, combined with the nozzle size, and bit size determines the effectiveness of the nozzle system's ability to clean the inserts.

It is believed that the minimum distance from the projected fluid path of the fluid column to the tip of the inserts should be approximately 3.0% of the bit diameter or less. For example, the clearance from the fluid column centerline to the nearest insert tip for a 17½" bit should be 0.525" (17.5*0.03) or less. For a 12¼" bit, the clearance should be 0.368" (12.25*0.03) or less for significant insert cleaning. It would be even more desirable to have the fluid column fluid distance be 2.0% or less of the bit diameter. Moving the fluid column closer to the insert tips can significantly increase rates of penetration as long as the cone shell is not eroded beyond acceptable limits. For example, cone shell erosion to an extent great enough to cause drill bit failure should generally be avoided as highly undesirable.

In addition, the shape of the discharge port may vary. For example, the discharge port may be a circle, an oval, an ellipse, a slit, a horseshoe shape, or any other suitable shape. For unusual shapes of the discharge port, determination of a centerpoint for the fluid column may be made by determining the centroid of the discharge port and projecting it along an axis created by the exit flow angle by methods known to one of ordinary skill in the art. Measurement from the closest point attained by the tip of an insert to the fluid column centroid may then be made.

One advantage of offsetting the discharge port of the nozzle retention body toward the leading or trailing cone is a simple method to achieve improved cone cleaning, minimal cone shell erosion, and high impact pressures for the fluid column on the borehole bottom. Where lateral translation of the discharged fluid column from the nozzle retention body is combined with direction of the fluid column such that it runs parallel or nearly parallel to the centerline of the bit, the highest stagnation zone possible on the hole bottom is generated while maintaining preferred flow patterns. Furthermore, the energy of the high velocity fluid will clean the inserts of chips that may have stuck to the cones. Moreover, as the inserts move in and out of the fluid stream, they will set up a pulsing flow on the hole bottom that can further enhance the ability of the fluid to overcome chip hold-down effects that reduce drilling rates.

Many of the same advantages as obtained with a directional nozzle body are present for a nozzle retention body having a vertical discharge port with lateral displacement. For example, since the nozzle retention body can be installed in only one position, installation is a simple process requiring no special fixtures. This is a significant advantage when retrofitting a bit in the field where the machine shops typically have limited capabilities due to the equipment available. Another advantage is interchanging one nozzle retention body with another can significantly change the hydraulics on the bit. Since the nozzle retention bodies are inexpensive in comparison to the cost of a fully manufactured bit, this makes a cost-effective way to change bit hydraulics without building multiple bits of the same type with different hydraulic configurations. As an additional advantage, the nozzle retention body can be used as a structure to further extend the nozzle toward the hole bottom and the nozzle may be manufactured into the nozzle retention body to make it a unitary whole. Moving the nozzle exit closer to the hole bottom increases bottom hole impingement pressures which improves bottom hole cleaning. Typically, the leg forging limits the extension of the nozzle due to forging requirements. By using the modular nozzle retention body, the nozzle can be extended toward the hole bottom for improved impact pressures. A nozzle retention body with lateral displacement of its discharge port may also be manufactured with the same general approach described above. Lastly, the interface between the nozzle retention body and the slot in the leg can be optimized for a continuous fluid path. Regardless of the position of the nozzle receptacle machined into the nozzle retention body, the interface between the nozzle retention body and slot remains unchanged and thus could be made to prevent any significant fluidic erosion.

Figure 20:
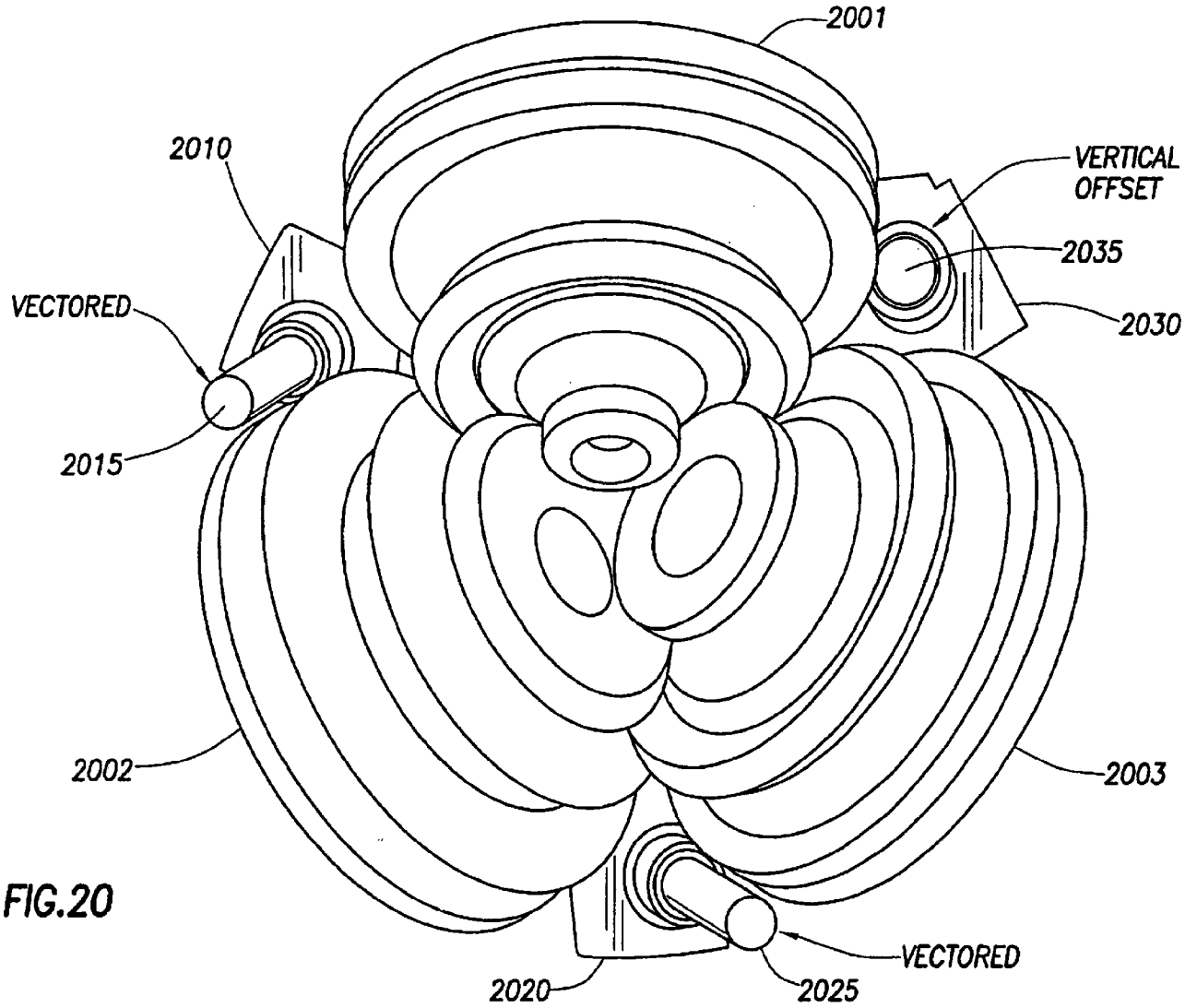
FIG. 20 is a bottom view of a drill bit having multiple nozzle retention bodies.

A bit may have a plurality of attachable devices as disclosed herein that may be directed to the same or different cones. Referring to FIG. 20, a drill bit body includes three rolling cones 2001–2003. Between each pair of rolling cones there is a nozzle retention body. Between rolling cones 2001 and 2002, a nozzle retention body 2010 with a flow path 2015 vectored from vertical and pointed at the trailing side of the rolling cone 2002. Between rolling cones 2002 and 2003, a second nozzle retention body 2020 has a flow path 2025 vectored from vertical. This flow path 2025 points at the trailing side of the rolling cone 2003. Between rolling cones 2003 and 2001, there is a nozzle retention body 2030 having a flow path offset from center and pointing vertically. This offset arrangement results in a flow path flowing past the trailing side of the rolling cone 2002. In this case, two canted attachable devices have been placed to create a helical flow pattern, and another attachable device was placed to direct vertical flow toward the bottom of the wellbore, creating high impingement pressure on the bottom of the wellbore.

Alternately, there might be one attachable device directed at the leading side of a cone and another device directed at the trailing side of the same cone. There can also be three cone bits with one, two, three or more of the attachable devices. For example, a three-cone drill bit might have an attachable device with vectored exit flow between a first pair of roller cones and an attachable device with a vertical (but displaced) exit flow between the second or third pair of roller cones. Between the remaining pair of roller cones there might be a vectored attachable device, an attachable device with a vertical exit flow (either displaced or not displaced), or even a standard nozzle attached directly to the drill bit body. There could also be one or two cone bits utilizing these devices.

Methods of designing the drill bits could include designing a bit through iteratively adjusting the nozzle location in order to optimize the magnitude of impingement pressure on the hole bottom. Alternatively, a bit could be designed through iteratively adjusting the nozzle location in order to optimize the fluid flow paths. A drill bit could be designed through iteratively adjusting the nozzle position to maximize the cleaning action on the cutting elements for an individual cone(s) all the while trying to maximize the impingement pressure and optimizing the fluid flow paths.

Thus, while the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

What is claimed is:

1. A roller cone drill bit, comprising:

a drill bit body with an exterior and defining a bit diameter, a longitudinal axis, and an internal fluid plenum for allowing fluid to pass through, and having at least a first cone;

an opening in said drill bit body adjacent said first cone from exterior to said interior plenum;

a nozzle retention body for attachment to said drill bit body adjacent said first cone, said nozzle retention body having an interior channel that is in fluid communication with said internal fluid plenum and with fluid outlet means for fluid discharge from said interior channel;

wherein said fluid is directed along a centerline within 3 degrees of parallel to said longitudinal axis and said first cone includes at least one cutting element with a cutting tip, the shortest distance between said cutting tip and said centerline being less than 3 percent of said bit diameter.

2. The roller cone rock bit of claim 1, said fluid outlet means including a nozzle retained in said nozzle retention body, said nozzle directing said fluid.

3. The roller cone drill bit of claim 1, wherein said fluid outlet means includes a nozzle receptacle defining a centroid, said centroid further defining a projected fluid line that is within 3 degrees of parallel to said longitudinal axis.

4. The roller cone drill bit of claim 3, wherein said projected fluid path is a face normal projected fluid path.

5. The roller cone drill bit of claim 3, wherein said projected fluid path is a parallel-to-centerline projected fluid path.

6. The roller cone drill bit of claim 3, wherein said projected fluid path is a projected average fluid path derived from combining directionality information of individual elements at the nozzle exit.

7. The roller cone drill bit of claim 1, wherein said fluid is directed along a projected fluid path that is within 2 degrees of parallel to said longitudinal axis.

8. The roller cone drill bit of claim 7, wherein said projected fluid path is a face normal projected fluid path.

9. The roller cone drill bit of claim 7, wherein said projected fluid path is a parallel-to-centerline projected fluid path.

10. The roller cone drill bit of claim 7, wherein said projected fluid path is a projected average fluid path derived from combining directionality information of individual elements at the nozzle exit.

11. The drill bit of claim 1, further comprising a second cone, wherein said outlet of said nozzle retention body is closer to said first cone than said second cone.

12. The drill bit of claim 11, wherein said first cone is a leading cone and said second cone is a trailing cone.

13. The drill bit of claim 11, wherein said first cone is a trailing cone and said second cone is a leading cone.

14. The drill bit of claim 2, further comprising:

said nozzle having an exit port with an exit surface, said exit surface defining a projected fluid path, wherein said first cone includes a number of cutting elements, the distance from said projected fluid path to said first cone being the minimum measured from the centroid of said exit surface projected along said projected fluid path to the closest point attained by the tips of said cutting elements.

15. The drill bit of claim 2, wherein said at least one cutting element is formed at least partially of sintered tungsten carbide.

16. The drill bit of claim 2, wherein said at least one cutting elements is formed at least partially of a diamond coating over the sintered tungsten carbide.

17. The drill bit of claim 2, wherein the cutting elements are at least partially protected with a hard metal coating.

18. The drill bit of claim 2, wherein the cutting elements are of milled teeth.

19. The drill bit of claim 2, wherein the cutting elements are of milled teeth at least partially treated to provide more wear resistance.

20. The roller cone drill bit of claim 1, further comprising:

a second cone;

a second nozzle retention body for attachment to said drill bit body adjacent said first cone;

said second nozzle retention body having an interior channel that is in fluid communication with said internal fluid plenum and with fluid outlet means for fluid discharge from said interior channel;

wherein said fluid from said second nozzle retention body is directed along a projected fluid path, wherein said second cone includes at least one cutting element with a cutting tip, the shortest distance between said cutting tip on said second cone and said projected fluid path being less than 3% of said bit diameter.

21. The roller cone drill bit of claim 20, wherein said projected fluid path is generally vertical.

22. The roller cone drill bit of claim 20, wherein said projected fluid path is at an angle other than generally vertical.

23. The drill bit of claim 1, wherein said nozzle retention body includes a leading and a trailing face, and wherein said fluid outlet is more proximate to said leading face than said trailing face.

24. The drill bit of claim 1, wherein said nozzle retention body includes a leading and a trailing face, and wherein said fluid outlet is more proximate to said trailing face than said leading face.

25. The drill bit of claim 1, wherein said nozzle retention body attaches to said drill bit body by a keyed engagement.

26. The drill bit of claim 1, wherein said nozzle retention body is metallurgically bonded to said bit body.

27. The drill bit of claim 26, wherein the metallurgical bond is a weld.

28. The drill bit of claim 1, wherein the nozzle retention body is mechanically attached to said bit body.

29. The drill bit of claim 28, wherein the method of attachment is screw or bolt.

30. The drill bit of claim 1, wherein as said first cone rotates, said at least one cutting element on said first cone enters said directed fluid for cleaning.

31. The drill bit of claim 1, wherein said fluid is directed along a projected fluid path that is within 3 degrees of parallel to said longitudinal axis, said projected fluid path being computed by a mass-weighted average fluid directionality.

32. The roller cone drill bit of claim 1, further comprising:

a second cone, wherein said fluid outlet means is a nozzle retention port laterally offset closer to said first cone than to said second cone.

33. The roller cone drill bit of claim 2, further comprising:

a second cone, wherein said centerline is parallel to said longitudinal axis and offset closer to said first cone than to said second cone.

34. The roller cone drill bit of claim 2, wherein said nozzle retention body has a centerline parallel to said longitudinal axis and said fluid outlet means is at an angle to said centerline of said nozzle retention body.

35. The roller cone drill bit of claim 34, said nozzle retention body and said drill bit body being constructed for keyed attachment between said nozzle retention body and said drill bit body.

36. The roller cone drill bit of claim 1, wherein said drill bit body has a top end, a bottom end, and a side between said top end and said bottom end, said opening being located on said side.

37. The drill bit of claim 1, wherein said fluid impinges on the well bore bottom to within 3 degrees of perpendicular to said well bore bottom.

38. A roller cone drill bit, comprising:

a drill bit body with an exterior and defining a bit diameter, a longitudinal axis, and an internal fluid plenum for allowing fluid to pass through, and having at least a first cone;

an opening in said drill bit body adjacent said first cone from exterior to said interior plenum;

a nozzle retention body for attachment to said drill bit body adjacent said first cone, said nozzle retention body having an interior channel that is in fluid communication with said internal fluid plenum and with fluid outlet means for fluid discharge from said interior channel;

wherein said fluid impinges on the well bore bottom perpendicular to said well bore bottom and wherein said fluid is directed along a centerline and said first cone includes at least one cutting element with a cutting tip, the shortest distance between said cutting tip and said centerline being less than 3% of said bit diameter.

39. A drill bit, comprising:

a drill bit body defining a longitudinal axis and a bit diameter;

a first nozzle retention body engaged with said drill bit body, said nozzle retention body having a first fluid exit port and being positioned between and adjacent a first pair of roller cones;

a second nozzle retention body engaged with said drill bit body, said second nozzle retention body having a second fluid exit port and being positioned between a second pair of roller cones;

a first nozzle engaged with said first nozzle retention body and defining a first projected fluid path that is generally parallel to said longitudinal axis;

a second nozzle engaged with said second nozzle retention body and defining a second projected fluid path that is not generally parallel to said longitudinal axis;

a third nozzle attached to said drill bit body and defining a third projected fluid path;

wherein said first fluid exit port is closer to one of said first pair of roller cones than the other and wherein said roller cone closer to said first fluid exit port includes at least one cutting element with a cutting tip, the shortest distance between said cutting tip and said first projected fluid path being less than 3% of said bit diameter.

40. The drill bit of claim 39, wherein said third projected fluid path is generally parallel to said longitudinal axis.

41. The drill bit of claim 39, wherein said third nozzle attaches to said drill bit body via a third nozzle retention body, said third nozzle retention body having a third fluid exit port and being positioned between a third pair of roller cones and further wherein said third projected fluid path is generally parallel to said longitudinal axis.

42. The drill bit of claim 41, wherein said third fluid exit port is closer to one of said third pair of roller cones than the other, and wherein said roller cone closer to said third fluid exit port includes at least one cutting element with a cutting tip, the shortest distance between said cutting tip and said third projected fluid path being less than 3% of said bit diameter.

43. The drill bit of claim 39, wherein said drill bit has three rolling cones.

44. The drill bit of claim 39, wherein said third nozzle attaches to said drill bit body via a third nozzle retention body, said third nozzle retention body having a third fluid exit port and being positioned between a third pair of roller cones and further wherein said third projected fluid path is not generally parallel to said longitudinal axis.

45. The drill bit of claim 39, wherein said third projected fluid path is not generally parallel to said longitudinal axis.

46. The drill bit of claim 39, wherein said third nozzle attaches directly to said drill bit body.

47. The drill bit of claim 39, wherein said third nozzle attaches to said drill bit body via a third nozzle retention body, said third nozzle retention body having a third fluid exit port that is positioned generally midway between a third pair of roller cones.

48. The drill bit of claim 39, wherein said first projected fluid path is computed by computational fluid dynamics using a mass-weighted average.

49. A roller cone drill bit, comprising:

a drill bit body with an exterior and defining a bit diameter, a longitudinal axis, and an internal fluid plenum for allowing fluid to pass through, and having at least a first cone;

an opening in said drill bit body adjacent said first cone from exterior to said interior plenum;

a nozzle retention body for attachment to said drill bit body adjacent said first cone, said nozzle retention body having an interior channel that is in fluid communication with said internal fluid plenum and with fluid outlet means for fluid discharge from said interior channel;

wherein said fluid is directed along a centerline within 3 degrees of parallel to said longitudinal axis and said first cone includes at least one cutting element with a cutting tip, the shortest distance between said cutting tip and said centerline being less than 3 percent of said bit diameter.

a second cone, wherein said centerline is offset closer to said first cone than to said second cone.

50. The roller cone drill bit of claim 49, further comprising:

wherein said centerline is parallel to said longitudinal axis.

51. A drill bit, comprising:

a drill bit body defining a longitudinal axis and a bit diameter;

a first nozzle retention body engaged with said drill bit body, said nozzle retention body having a first fluid exit port and being positioned between and adjacent a first pair of roller cones;

a second nozzle retention body engaged with said drill bit body, said second nozzle retention body having a second fluid exit port and being positioned between a second pair of roller cones;

a first nozzle engaged with said first nozzle retention body and defining a first projected fluid path that is generally parallel to said longitudinal axis;

a second nozzle engaged with said second nozzle retention body and defining a second projected fluid path that is not generally parallel to said longitudinal axis;

wherein said first fluid exit port is closer to one of said first pair of roller cones than the other and wherein said roller cone closer to said first fluid exit port includes at least one cutting element with a cutting tip, the shortest distance between said cutting tip and said first projected fluid path being less than 3% of said bit diameter.

52. The drill bit of claim 51, wherein said first projected fluid path is computed by computational fluid dynamics using a mass-weighted average.

53. A drill bit, comprising:

a drill bit body defining a longitudinal axis and a bit diameter;

a first nozzle retention body engaged with said drill bit body, said nozzle retention body having a first fluid exit port and being positioned between and adjacent a first pair of roller cones, said first fluid exit port defining a first projected fluid path that is generally parallel to said longitudinal axis;

a second nozzle retention body engaged with said drill bit body, said second nozzle retention body having a second fluid exit port and being positioned between a second pair of roller cones, said second fluid exit port defining a second projected fluid path that is generally parallel to said longitudinal axis;

wherein said first fluid exit port is closer to one of said first pair of roller cones than the other and wherein said roller cone closer to said first fluid exit port includes at least one cutting element with a cutting tip, the shortest distance between said cutting tip and said first projected fluid path being less than 3% of said bit diameter.

54. The drill bit of claim 53, further comprising:

a third nozzle retention body, said third nozzle retention body having a third fluid exit port, defining a third projected fluid path, and being positioned between a third pair of roller cones.

55. The drill bit of claim 54, wherein said third projected fluid path is generally parallel to said longitudinal axis.

56. The drill bit of claim 54, wherein said third fluid exit port is closer to one of said third pair of roller cones than the other, and wherein said roller cone closer to said third fluid exit port includes at least one cutting element with a cutting tip, the shortest distance between said cutting tip and said third projected fluid path being less than 3% of said bit diameter.

57. The drill bit of claim 54, wherein said drill bit has three rolling cones.

58. The drill bit of claim 54, further comprising a third nozzle attached to said drill bit body and, wherein said third nozzle attaches to said drill bit body via said third nozzle retention body, said third nozzle retention body having a third fluid exit port and being positioned between a third pair of roller cones and further wherein said third projected fluid path is not generally parallel to said longitudinal axis.

59. The drill bit of claim 54, wherein said third projected fluid path is not generally parallel to said longitudinal axis.

* * * * *